US008430347B2

(12) United States Patent
Jensen et al.

(10) Patent No.: US 8,430,347 B2
(45) Date of Patent: Apr. 30, 2013

(54) THICKNESS ADJUSTED MOTOR CONTROLLER

(75) Inventors: Michael D. Jensen, Wood Dale, IL (US); Tai Hoon K. Matlin, Round Lake Beach, IL (US); Chen Hai Ting, SuZhou (CN)

(73) Assignee: Fellowes, Inc., Itasca, IL (US)

( * ) Notice: Subject to any disclaimer, the term of this patent is extended or adjusted under 35 U.S.C. 154(b) by 649 days.

(21) Appl. No.: 12/579,905

(22) Filed: Oct. 15, 2009

(65) Prior Publication Data

US 2010/0170969 A1 Jul. 8, 2010

Related U.S. Application Data

(63) Continuation-in-part of application No. 12/348,420, filed on Jan. 5, 2009, now Pat. No. 8,201,761.

(51) Int. Cl.
*B02C 4/32* (2006.01)
*B02C 7/14* (2006.01)

(52) U.S. Cl.
USPC ..... 241/36; 241/100; 241/236

(58) Field of Classification Search ..... 241/25, 241/30, 36, 236, 100, 101.3
See application file for complete search history.

(56) References Cited

U.S. PATENT DOCUMENTS

| | | | |
|---|---|---|---|
| 2,221,516 | A | 4/1937 | Hathaway |
| 3,619,537 | A | 11/1971 | Hosokawa et al. |
| 3,724,766 | A | 4/1973 | Bosland |
| 3,764,819 | A | 10/1973 | Muller |
| 3,785,230 | A | 1/1974 | Lokey |
| 3,829,850 | A | 8/1974 | Guetersloh |
| 3,947,734 | A | 3/1976 | Fyler |
| 4,192,467 | A | 3/1980 | Hatanaka |
| 4,352,980 | A | 10/1982 | Hibari |
| 4,378,717 | A | 4/1983 | Schneider et al. |
| 4,489,897 | A | 12/1984 | Turner |
| 4,495,456 | A | 1/1985 | Vercillo et al. |

(Continued)

FOREIGN PATENT DOCUMENTS

| | | |
|---|---|---|
| DE | 3313232 | 10/1984 |
| DE | 8619856.4 | 10/1988 |

(Continued)

OTHER PUBLICATIONS

GBC Shredmaster Service Manual, Part #6001054, referencing Models 2230S and 2250X Paper Shredders, Nov. 1997.

(Continued)

*Primary Examiner* — Bena Miller
(74) *Attorney, Agent, or Firm* — Pillsbury Winthrop Shaw Pittman LLP

(57) ABSTRACT

A shredder includes a housing having a throat for receiving at least one article to be shredded, a shredder mechanism received in the housing and including a powered motor and cutter elements used to shred the at least one article, a detector configured to detect a presence of the at least one article being received by the throat, and a controller coupled to the motor and the detector. The controller is configured to allow a running operation of the motor responsive to the detector detecting an article being received by the throat. Also, after a predetermined amount of time, the controller may stop operation of the motor if an article is not inserted into the throat. A thickness detector may also be used in the shredder.

28 Claims, 12 Drawing Sheets

U.S. PATENT DOCUMENTS 4,497,478 A 2/1985 Reschenhofer
4,683,381 A 7/1987 Dufoug
4,707,704 A 11/1987 Allen
4,757,949 A 7/1988 Horton
4,814,632 A 3/1989 Glaeser
4,815,669 A 3/1989 Fujii
4,842,205 A 6/1989 Araki
4,889,291 A 12/1989 Goldhammer et al.
4,890,797 A 1/1990 Fujii et al.
4,914,721 A 4/1990 Glaeser
5,017,972 A 5/1991 Daughton
5,081,406 A 1/1992 Hughes et al.
5,139,205 A 8/1992 Gallagher et al.
5,166,679 A 11/1992 Vranish et al.
5,167,374 A 12/1992 Strohmeyer
5,186,398 A 2/1993 Vigneau, Jr.
5,198,777 A 3/1993 Masuda et al.
5,342,033 A 8/1994 Iwata
5,345,138 A 9/1994 Mukaidono et al.
5,353,468 A 10/1994 Yap
5,397,890 A 3/1995 Schueler et al.
5,409,171 A 4/1995 Stangenberg et al.
5,415,355 A 5/1995 Gollwitzer
5,429,313 A 7/1995 Schwelling
5,453,644 A 9/1995 Yap
5,494,229 A 2/1996 Rokos
5,539,322 A 7/1996 Zoughi et al.
5,662,280 A 9/1997 Nishio et al.
5,743,521 A 4/1998 Munakata et al.
5,772,129 A 6/1998 Nishio et al.
5,775,605 A 7/1998 Tsai
5,823,529 A 10/1998 Mandel
5,850,342 A 12/1998 Nakamura et al.
5,871,162 A 2/1999 Rajewski
5,924,637 A 7/1999 Niederholtmeyer
D412,716 S 8/1999 Kroger
5,942,975 A 8/1999 Sorenson
D414,198 S 9/1999 Iwata
5,988,542 A 11/1999 Henreckson
6,065,696 A 5/2000 Tsai
D426,805 S 6/2000 Iwata
6,079,645 A 6/2000 Henreckson et al.
6,116,528 A 9/2000 Schwelling
6,141,883 A 11/2000 Mitchell et al.
6,265,682 B1 7/2001 Lee
6,376,939 B1 4/2002 Suzuki et al.
6,418,004 B1 7/2002 Mather et al.
6,518,794 B2 * 2/2003 Coteus et al. ..... 326/93
6,550,701 B1 4/2003 Chang
6,561,444 B1 5/2003 Yokomine et al.
6,601,787 B1 8/2003 Langenecker
6,655,943 B1 12/2003 Peterson
6,666,959 B2 12/2003 Uzoh et al.
6,676,460 B1 1/2004 Motsenbocker
6,698,640 B2 3/2004 Hakozaki
6,724,324 B1 4/2004 Lambert
6,802,465 B1 10/2004 Norcott et al.
6,979,813 B2 12/2005 Avril
6,983,903 B2 1/2006 Chang
6,997,408 B2 2/2006 Watano
7,025,293 B2 4/2006 Matlin et al.
7,040,559 B2 5/2006 Matlin
7,166,561 B2 1/2007 Allen
7,210,867 B1 5/2007 Silverbrook
7,213,780 B2 5/2007 Chen
7,311,276 B2 12/2007 Matlin et al.
7,490,786 B2 2/2009 Matlin et al.
7,520,452 B2 4/2009 Watano et al.
7,584,545 B2 9/2009 Pan et al.
7,624,938 B2 12/2009 Aries et al.
7,631,822 B2 12/2009 Matlin et al.
7,631,823 B2 12/2009 Matlin et al.
7,631,824 B2 12/2009 Matlin et al.
7,635,102 B2 12/2009 Matlin et al.
7,661,614 B2 2/2010 Matlin et al.
7,663,769 B2 2/2010 Hayashihara et al.
7,712,689 B2 5/2010 Matlin et al.
2003/0016365 A1 1/2003 Liess et al.
2003/0042342 A1 3/2003 Kroger et al.
2004/0008122 A1 1/2004 Michael
2004/0069883 A1 4/2004 Watanabe et al.
2004/0159198 A1 8/2004 Peot et al.
2004/0194594 A1 10/2004 Dils et al.
2004/0226800 A1 11/2004 Pierga
2005/0046651 A1 3/2005 Askren et al.
2005/0150986 A1 7/2005 Castronovo
2005/0213106 A1 9/2005 Weijers et al.
2006/0016919 A1 1/2006 Castronovo
2006/0054725 A1 3/2006 Matlin
2006/0091247 A1 5/2006 Matlin
2006/0219827 A1 10/2006 Matlin
2006/0243631 A1 11/2006 Duke
2007/0007373 A1 1/2007 Matlin
2007/0025239 A1 2/2007 Jain et al.
2007/0063082 A1 3/2007 Coleman
2007/0080252 A1 4/2007 Pierce
2007/0087942 A1 4/2007 Allen
2007/0164135 A1 7/2007 Zhong
2007/0164138 A1 7/2007 Allen
2007/0215728 A1 9/2007 Priester
2007/0221767 A1 9/2007 Matlin
2007/0246582 A1 10/2007 Aries et al.
2008/0093487 A1 4/2008 Lee
2008/0231261 A1 9/2008 Dengler et al.
2009/0025239 A1 1/2009 Pan
2009/0032629 A1 2/2009 Aries et al.
2009/0090797 A1 4/2009 Matlin et al.
2010/0051731 A1 3/2010 Matlin et al.
2010/0084496 A1 4/2010 Matlin et al.
2010/0102153 A1 4/2010 Matlin et al.
2010/0134805 A1 6/2010 Pan
2010/0170967 A1 7/2010 Jensen et al.
2010/0170969 A1 7/2010 Jensen et al.
2010/0176227 A1 7/2010 Davis et al.
2010/0181398 A1 7/2010 Davis et al.
2010/0213296 A1 8/2010 Sued et al.
2010/0213297 A1 8/2010 Sued et al.
2010/0213300 A1 8/2010 Matlin et al.
2010/0243774 A1 9/2010 Hu et al.
2010/0252661 A1 10/2010 Matlin et al.
2010/0252664 A1 10/2010 Matlin et al.
2010/0270404 A1 10/2010 Chen
2010/0282879 A1 11/2010 Chen
2010/0288861 A1 11/2010 Cai et al.
2010/0320297 A1 12/2010 Matlin et al.
2010/0320299 A1 12/2010 Matlin et al.
2011/0272504 A1 11/2011 Matlin et al.
2011/0272505 A1 11/2011 Matlin et al.
2011/0280642 A1 11/2011 Ikeda et al.
2011/0297769 A1 12/2011 Matlin et al.
2011/0297770 A1 12/2011 Matlin et al.

FOREIGN PATENT DOCUMENTS

DE 4121330 1/1993
DE 4207292 1/1993
DE 4237861 5/1994
DE 4437348 4/1996
DE 19835093 2/1999
DE 202004000907 5/2005
DE 102006036136 1/2008
DE 202010001577 U1 11/2010
EP 268244 11/1987
EP 0392867 10/1990
EP 562076 9/1992
EP 524708 1/1997
EP 0792691 9/1997
EP 0818241 1/1998
EP 856945 1/1998
EP 855221 7/1998
EP 1177832 2/2002
EP 1195202 4/2002
EP 2180290 7/2008
EP 2022566 2/2009
GB 1199903 7/1970
GB 2171029 8/1986
GB 2209963 6/1989
GB 2440651 2/2008

| | | |
|---|---|---|
| GB | 2442942 | 4/2008 |
| GB | 2451513 | 2/2009 |
| JP | 52-11691 | 1/1977 |
| JP | 5311911 | 3/1978 |
| JP | 57-070445 | 4/1982 |
| JP | 57-070445 U | 4/1982 |
| JP | 57-76734 | 5/1982 |
| JP | 58-223448 | 12/1983 |
| JP | 59150554 | 8/1984 |
| JP | 61-000702 | 1/1986 |
| JP | 62183555 | 11/1987 |
| JP | 63-173342 | 11/1988 |
| JP | 2-277560 | 11/1990 |
| JP | H2-303550 | 12/1990 |
| JP | 04-157093 | 5/1992 |
| JP | 04-0180852 | 6/1992 |
| JP | 5-96198 | 4/1993 |
| JP | H05-092144 | 4/1993 |
| JP | 6-277548 | 10/1994 |
| JP | 7-299377 | 11/1995 |
| JP | 8-108088 | 4/1996 |
| JP | 8-131861 | 5/1996 |
| JP | 08-131962 | 5/1996 |
| JP | 08-164343 | 6/1996 |
| JP | 9-38513 | 2/1997 |
| JP | 09075763 | 3/1997 |
| JP | 09-150069 | 10/1997 |
| JP | 9-262491 | 10/1997 |
| JP | 10-048344 | 2/1998 |
| JP | 11-216383 | 8/1999 |
| JP | 11-304942 | 11/1999 |
| JP | 2000346288 | 12/2000 |
| JP | 2002-239405 | 8/2002 |
| JP | 2004-321840 | 11/2004 |
| JP | 2004321993 | 11/2004 |
| WO | 2005070553 | 8/2005 |
| WO | 2006019985 | 2/2006 |
| WO | 2006036370 | 4/2006 |
| WO | 2007109753 | 9/2007 |
| WO | 2007122364 | 11/2007 |
| WO | 2007137761 | 12/2007 |

OTHER PUBLICATIONS

The Stationary and Business Machines—Japan, "DS-4000 by Carl Jimuki K.K.", Jun. 2003.

The Stationary and Business Machines—Japan, "NSE-501 CN by Nakabayashi K.K.", Oct. 2004.

English Translation of Japanese Patent Application Publication No. 9-38513, published on Feb. 10, 1997.

U.S. Appl. No. 60/613,750, filed Sep. 27, 2004, Pierce.

U.S. Appl. No. 60/686,490, filed May 31, 2005, Pierce.

U.S. Appl. No. 60/688,285, filed Jun. 7, 2005, Pierce.

Invitation to Pay Additional Fees with Partial International Search Report in PCT/US2009/069426, mailed Jun. 1, 2010.

International Search Report and Written Opinion for PCT International Patent Application No. PCT/US2009/069426, dated Aug. 23, 2010.

International Preliminary Report on Patentability for PCT/US2009/069426 dated Mar. 15, 2011.

Complaint for Declaratory Judgment filed on Nov. 15, 2010 by Royal Applicance Manufacturing Co., d/b/a/ TTI Floor Care North America and Techtronic Industries Co. Ltd. against Fellowes, Inc.

ACCO REXEL, Mainstream 1050/2150/2250/3150/3250 and 3350, 115V Machines Illustrated Parts Lists and Services Instructions, Mar. 25, 2002, Issue No. 4.

ACCO REXEL, Deckside and Office 115V Machines Illustrated Parts Lists and Service Instructions, Aug. 18, 1999.

ACCO REXEL, Deckside and Office 230V Machines Illustrated Parts Lists and Service Instructions, Aug. 1, 2000.

* cited by examiner

THICKNESS ADJUSTED MOTOR CONTROLLER

CROSS REFERENCE TO RELATED APPLICATIONS

The present application claims priority to U.S. Application Ser. No. 12/348,420 filed Jan. 5, 2009, the entirety of which is hereby incorporated into the present application by reference.

BACKGROUND OF THE INVENTION

1. Field of the Invention

The present invention relates to shredders for destroying articles, such as documents, compact discs, etc.

2. Description of Related Art

Shredders are well known devices for destroying articles, such as paper, documents, compact discs ("CDs"), expired credit cards, etc. Typically, users purchase shredders to destroy sensitive information bearing articles, such as credit card statements with account information, documents containing company trade secrets, etc.

A common type of shredder has a shredder mechanism contained within a housing that is removably mounted atop a container. The shredder mechanism typically has a series of cutter elements that shred articles fed therein and discharge the shredded articles downwardly into the container. The shredder typically has a stated capacity, such as the number of sheets of paper (typically of 20 lb. weight) that may be shredded at one time; however, the feed throat of a typical shredder can receive more sheets of paper than the stated capacity. This is typically done to make feeding easier. A common frustration of users of shredders is to feed too many papers into the feed throat, only to have the shredder jam after it has started to shred the papers. To free the shredder of the papers, the user typically reverses the direction of rotation of the cutter elements via a switch until the papers become free.

The assignee of the present application, Fellowes, Inc., has developed thickness sensing technologies for shredders. By sensing thickness of the articles being fed, the shredder can be stopped (or not started) before a jam occurs. See U.S. Patent Application Publication Nos. 2006-0219827 A1, 2006-0054725 A1, 2007-0007373 A1 and 2007-0221767 A1, and U.S. patent application Ser. No. 11/867,260, each of which is incorporated by reference herein in their entirety.

Sheet capacity, shredding speed, and energy efficiency are three important parameters of a shredder. Prior art shredders have attempted to address the issue of energy efficiency or energy savings by using a closed-loop feedback based motor control circuits. For example, see U.S. Patent Publication Nos. 2007-0164135 A1 and U.S. Pat. No. 6,997,408, each of which is incorporated by reference herein in their entirety.

BRIEF SUMMARY OF THE INVENTION

In an embodiment, a shredder is provided. The shredder includes a housing having a throat for receiving at least one article to be shredded, a shredder mechanism received in the housing, a detector, and a controller coupled to a motor and the detector. The shredder mechanism includes the electrically powered motor and cutter elements. The shredder mechanism enables the at least one article to be shredded to be fed into the cutter elements. The motor is operable to drive the cutter elements so that the cutter elements shred the articles fed therein. The detector is configured to detect a thickness of the at least one article being received by the throat. The controller is configured to start a running operation of the motor to at least a predetermined minimum speed responsive to the detector detecting the thickness of the at least one article being received by the throat when the thickness is less than a predetermined maximum thickness threshold.

In another embodiment, a method for operating a shredder is provided. The method uses a shredder that includes a housing having a throat for receiving at least one article to be shredded, a thickness detector for detecting a thickness of the at least one article to be shredded inserted in the throat, a controller coupled to a motor and the detector, and a shredder mechanism received in the housing. The shredder mechanism includes an electrically powered motor and cutter elements. The shredder mechanism enables the at least one article to be shredded to be fed into the cutter elements. The motor is operable drive the cutter elements in a shredding direction so that the cutter elements shred the articles fed therein. The method includes: detecting with the thickness detector a thickness of the at least one article to be shredded inserted into the throat; and starting running operation of the motor using the controller to at least a predetermined minimum speed responsive to the detector detecting the thickness of the at least one article being received by the throat when the thickness is less than a predetermined maximum thickness threshold.

In another embodiment, a shredder is provided. The shredder includes a housing having a throat for receiving at least one article to be shredded, a shredder mechanism received in the housing, input device, and a controller coupled to a motor and the detector. The shredder mechanism includes the electrically powered motor and cutter elements. The shredder mechanism enables the at least one article to be shredded to be fed into the cutter elements. The motor is operable to drive the cutter elements so that the cutter elements shred the articles fed therein. The input device transmits an input parameter indicating a physical characteristic of the at least one article being received by the throat. The controller is configured to start a running operation of the motor at at least a predetermined minimum speed after the input parameter of at least one article is transmitted by the input device. The controller is configured to detennine a maximum speed for the motor based on the input parameter from the input device. The controller is also configured to incrementally increase the running operation of the motor from the predetermined minimum speed to the determined maximum speed for shredding the at least one article using the cutter elements. The controller is configured to stop operation of the motor from driving the cutter elements upon the input device failing to detector another article being received by the throat after a predetermined amount of time.

In yet another embodiment, a method for operating a shredder is provided. The method uses a shredder that includes a housing having a throat for receiving at least one article to be shredded, an input device that transmits an input parameter indicating a physical characteristic of the at least one article being received by the throat, a controller coupled to a motor and the detector, and a shredder mechanism received in the housing. The shredder mechanism includes an electrically powered motor and cutter elements. The shredder mechanism enables the at least one article to be shredded to be fed into the cutter elements. The motor is operable drive the cutter elements in a shredding direction so that the cutter elements shred the articles fed therein. The method includes: transmitting the input parameter indicating the physical characteristic of the at least one article being received by the throat from the input device to the controller; starting a running operation of the motor using the controller at at least a predetermined minimum speed after the at least one article is detected by the detector; determining a maximum speed for operating the motor based on the transmitted input parameter from the input device; increasing the running operation of the motor in increments to the determined maximum speed, and stopping operation of the motor from driving the cutter elements using the controller upon the detector failing to detect another article being received by the throat after a predetermined amount of time.

Other aspects, features, and advantages of the present invention will become apparent from the following detailed description, the accompanying drawings, and the appended claims.

DETAILED DESCRIPTION OF THE INVENTION

The present invention relates to a shredder for destroying articles, such as documents, and CDs, specifically one capable of controlling motor torque, motor speed and energy efficiency based on the thickness of articles received by a throat of the shredder.

According to an aspect of the present invention, an intelligent motor controller for the shredder is provided. The motor controller is capable of determining the thickness of the articles received by the throat of the shredder, and accordingly adjusting the speed and the torque characteristic of the motor, which powers the shredder mechanism, based on an input (i.e., the thickness of the articles) from an input device (e.g., thickness detector). The controller is able to enhance shredding speed, shredding capacity or energy efficiency of the shredder.

According to an aspect of the present invention, an open-loop control system is provided that is capable of determining the speed and torque of the motor based on the thickness of the article to be shredded. The present invention may be implemented in conjunction with an induction motor, a universal motor or a brushless DC motor or any other electric motor with capability for torque or speed control.

The present invention anticipates the required speed and torque of the motor based on the thickness of at least one article before the article even enters the cutter elements. The present invention is therefore able to determine the motor torque, the motor speed or energy efficiency before it turns on the motor. It is also able to variably adjust the shredding speed, capacity and energy efficiency during the shredding operation before the motor is affected by the change in load, thereby improving energy efficiency.

Figure 1:
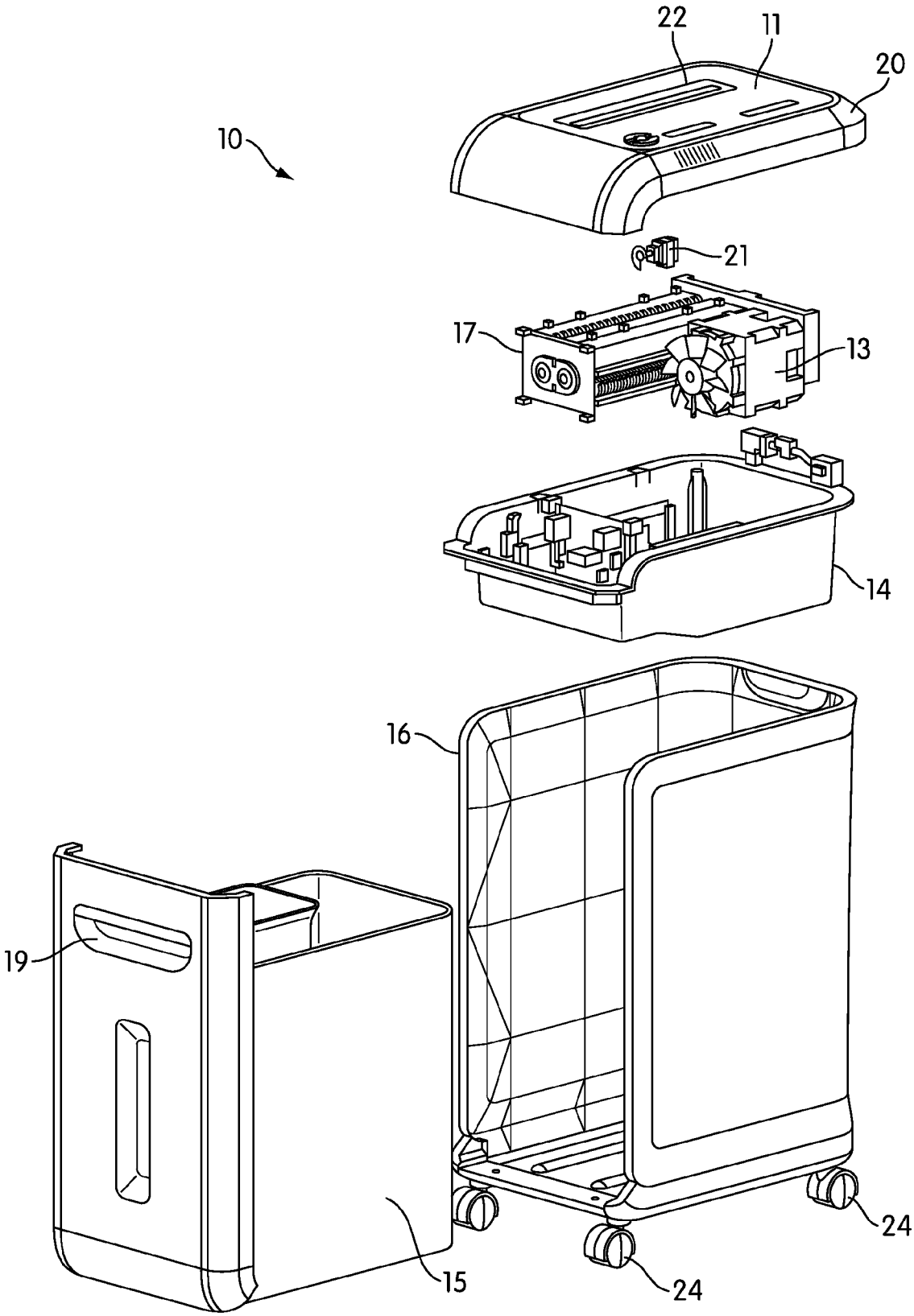
FIG. 1 is an exploded perspective view of a shredder constructed in accordance with an embodiment of the present invention.
Figure 3:
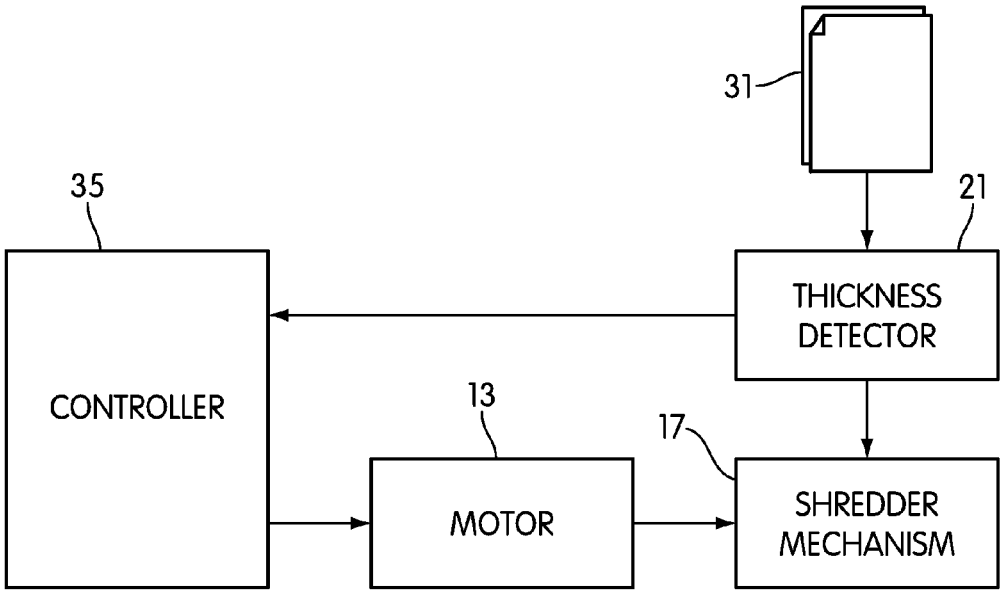
FIG. 3 is schematic illustration of interaction between a controller and other parts of the shredder.

FIG. 1 illustrates a shredder constructed in accordance with an embodiment of the present invention. The shredder is generally indicated at 10. The shredder includes a housing 20 having a throat 22 for receiving at least one article 31 (as shown in FIG. 3) to be shredded, a shredder mechanism 17 received in the housing 20, an input device in the form of a detector 21, and a controller 35 (as shown in FIG. 3) coupled to a electrically powered motor 13 and the detector 21. The shredder mechanism 17 includes the motor 13 and cutter elements. The shredder mechanism 17 enables the at least one article 31 to be shredded to be fed into the cutter elements. The motor 13 is operable to drive the cutter elements so that the cutter elements shred the articles 31 fed therein. The input device 21 transmits an input parameter indicating a physical characteristic of the at least one article being received by the throat. As noted above, the input device may be in the form of a detector. In the illustrated embodiment, the detector 21 is configured to detect a presence of the at least one article 31 in the throat 22. The detector 21 is also configured to detect a thickness of the at least one article 31 received by the throat 22. Thus, the detector 21 may detect an article's presence and thickness. Of course, in some cases, separate detectors may be used, with one detector for detecting the presence of an article in the throat and another detector for detecting the thickness of the article. For this disclosure, however, only a single detector 21 is shown and described. The controller 35 is configured to vary the running operation of the motor responsive to the detector detecting the presence and/or thickness of the at least one article being received by the throat.

The shredder 10 includes the shredder housing 20, mentioned above. The shredder housing 20 includes a top cover 11, and a bottom receptacle 14. The shredder housing 20 includes the top cover or wall 11 that sits atop the upper periphery of the bottom receptacle 14. The top cover or wall 11 is molded from a plastic material or any other material. The shredder housing 20 and its top wall or cover 11 may have any suitable construction or configuration. The top cover or wall 11 has an opening, which is often referred to as the throat 22, extending generally parallel and above the cutter elements. The throat 22 enables the articles being shredded to be fed into the cutter elements. As can be appreciated, the throat 22 is relatively narrow, which is desirable for preventing overly thick items, such as large stacks of documents, from being fed into cutter elements, which could lead to jamming. The throat 22 may have any configuration.

The shredder 10 includes the bottom receptacle 14 having a bottom wall, four side walls and an open top. The bottom receptacle 14 is molded from a plastic material or any other material. The bottom receptacle 14 sits atop the upper periphery of the bottom housing 16 in a nested relation using flange portions of the bottom receptacle 14 that generally extend outwardly from the side walls thereof. The shredder mechanism 17 along with the motor 13, and the detector 21 are configured to be received in the bottom receptacle 14 of the shredder housing 20. The bottom receptacle 14 may be affixed to the underside of the top cover or wall 11 by fasteners. The receptacle 14 has an opening in its bottom wall through which the shredder mechanism 17 discharges shredded articles into the container 15.

As noted above, the shredder 10 includes the shredder mechanism 17 that includes the electrically powered motor 13 and a plurality of cutter elements. "Shredder mechanism" is a generic structural term to denote a device that destroys articles using at least one cutter element. Such destroying may be done in any particular way. For example, the shredder mechanism may include at least one cutter element that is configured to punch a plurality of holes in the document or article in a manner that destroys the document or article. In the illustrated embodiment, the cutter elements are generally mounted on a pair of parallel rotating shafts. The motor 13 operates using electrical power to rotatably drive the shafts and the cutter elements through a conventional transmission so that the cutter elements shred articles fed therein. The shredder mechanism 17 may also include a sub-frame for mounting the shafts, the motor 13, and the transmission. The operation and construction of such a shredder mechanism 17 are well known and need not be described herein in detail. Generally, any suitable shredder mechanism 17 known in the art or developed hereafter may be used.

In the illustrated embodiment, the shredder 10 sits atop the large freestanding housing 16, which is formed of molded plastic material or any other material. The housing 16 includes a bottom wall, three side walls, an open front and an open top. The side walls of the container 16 provide a seat on which the shredder housing 20 is removably mounted. The housing 16 is constructed and arranged to receive the waste container 15 therein. In other words, the waste container 15 is enclosed in the housing 16. The waste container 15 is formed of molded plastic material or any other material. The waste container 15 is in the form of a pull-out bin that is constructed and arranged to slide in and out of the housing 16 through an opening in the front side thereof. The waste container 15 is configured to be removably received within the housing 16. The waste container 15 includes a bottom wall, four side walls, and an open top. The waste container 15 includes a handle 19 that is configured to allow a user to grasp and pull out the waste container 15 from the housing 16. In the illustrated embodiment, the handle 19 is located on the front, side wall of the waste container 15. Any construction or configuration for the housing or waste container may be used, and the illustrated embodiment is not limiting.

As an option, the housing 16 along with the shredder 10 can be transported from one place to another by simply rolling the housing 16 on roller members 24, such as wheels or casters. In the illustrated embodiment, the housing 16 includes two pairs of roller members 24 attached to the bottom of the frame of the housing 16 to rollingly support the housing 16. The rolling members 24 can be located on the housing 16 as near the corners as practical. The roller members 24, in one embodiment, may be locked against rolling motion by lock members to provide a stationary configuration. In one embodiment, the front pair of the roller members 24 may be in the form of casters that provide a turning capability to the housing 16, while the rear pair of the roller members 24 may be in the form of wheels that are fixed in direction, so as to only allow roll in the intended direction of travel. In another embodiment, the front and rear pair of the roller members 24 may in the form of casters.

The cover 11 may include a switch recess with an opening therethrough. An on/off switch that includes a switch module may be mounted to the top cover 11 underneath the switch recess by fasteners, and a manually engageable portion that moves laterally within the switch recess. The switch module has a movable element that connects to the manually engageable portion through the opening. This enables movement of the manually engageable portion to move the switch module between its states.

The switch module is configured to connect the motor 13 to the power supply. This connection may be direct or indirect, such as via a controller. Typically, the power supply will be a standard power cord with a plug on its end that plugs into a standard AC outlet. The switch is movable between an on position and an off position by moving the manually engageable portion laterally within the switch recess. In the on position, contacts in the switch module are closed by movement of the manually engageable portion and the movable element to enable a delivery of electrical power to the motor 13. In the off position, contacts in the switch module are opened to disable the delivery of electric power to the motor 13. Alternatively, the switch may be coupled to a controller, which in turn controls a relay switch, TRIAC, etc., for controlling the flow of electricity to the motor 13, as will be described in detail below.

As an option, the switch may also have a reverse position wherein contacts are closed to enable delivery of electrical power to operate the motor 13 in a reverse manner. This would be done by using a reversible motor and applying a current that is of a reverse polarity relative to the on position. The capability to operate the motor 13 in a reversing manner is desirable to move the cutter elements in a reversing direction for clearing jams. In the off position the manually engageable portion and the movable element would be located generally in the center of the switch recess, and the on and reverse positions would be on opposing lateral sides of the off position.

Generally, the construction and operation of the switch for controlling the motor 13 are well known and any construction for such a switch may be used. For example, the switch need not be mechanical and could be of the electro-sensitive type described in U.S. patent application Ser. No. 11/536,415 filed Sep. 28, 2006 and published as U.S. Patent Application No. 20080099590 A1 on May 1, 2008, assigned to the same assignee as the present invention. Likewise, such as switch may be entirely omitted, and the shredder can be started based on insertion of an article to be shredded.

Generally speaking, the shredder 10 may have any suitable construction or configuration and the illustrated embodiment is not intended to be limiting in any way. In addition, the term "shredder" is not intended to be limited to devices that literally "shred" documents and articles, but is instead intended to cover any device that destroys documents and articles in a manner that leaves each document or article illegible and/or useless.

Figure 2:
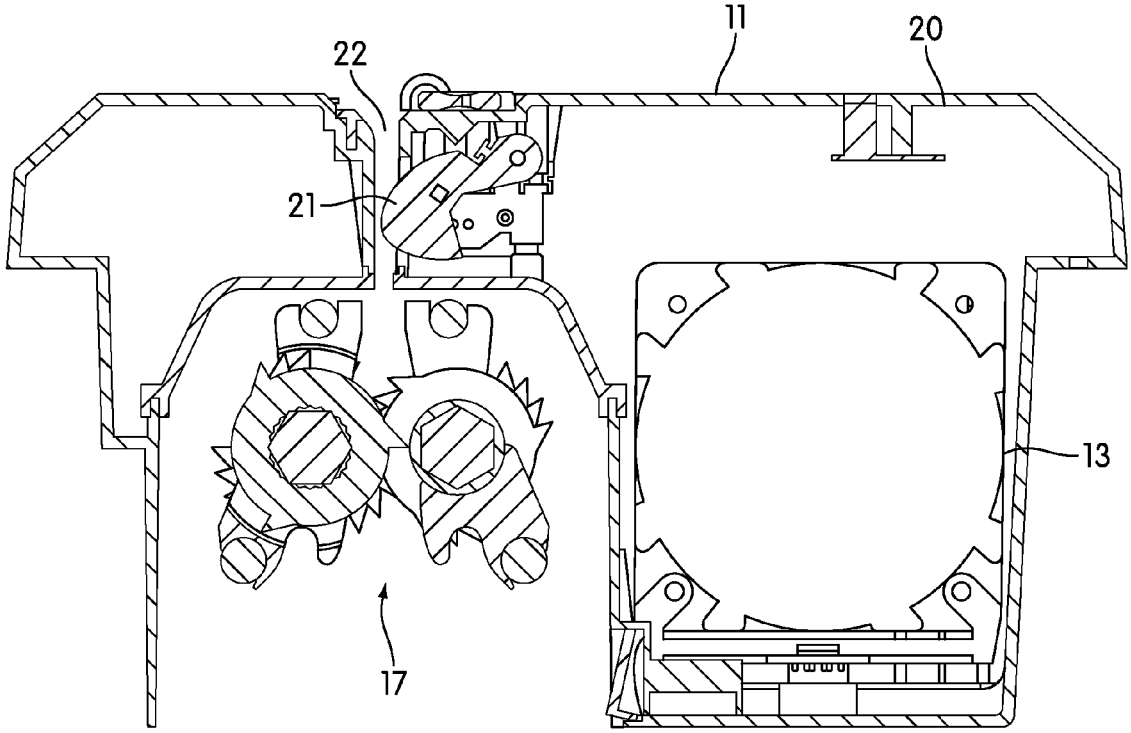
FIG. 2 is a cross-sectional view of the shredder of FIG. 1, wherein a detector configured to detect a thickness of an article to be shredded by the shredder in accordance with an embodiment of the present invention.

FIG. 2 shows an embodiment of the detector 21 that may be used to detect the thickness of articles (e.g., a compact disc, credit card, stack of paper, etc.) that are placed in the throat 22 of the shredder 10. In this embodiment, the detector 21 includes a contact member that extends into the throat 22 and is actuated in response to the article being inserted into the throat 22. The detector 21 may include a strain gauge configured to measure movement of the contact member and communicate the movement to a controller. The detector 21 may include a piezoelectric sensor configured to measure movement of the contact member and communicate the movement to a controller. The detector 21 may include an optical sensor configured to measure movement of the contact member and communicate the movement to a controller. The optical sensor may include an infrared LED and a dual die infrared receiver configured to detect the direction and amount of the movement. Reference may be made to U.S. Patent Application Publication No. 2006/0219827 A1, filed Jun. 1, 2006 and assigned to the same assignee, which is hereby incorporated by reference in its entirety, for details of a detector that is configured to detect a thickness of the at least one article received by the throat. The detector may have any construction or configuration, and the illustrated embodiment is not limiting.

FIG. 3 shows the controller 35 capable of controlling the motor 13 that powers the shredder mechanism 17. The detector 21 in this example is configured to detect at least the thickness of the article(s) 31 received by the throat 22 of the shredder 10, and to relay the thickness of the article(s) 31 to the controller 35. The controller or control circuit 35 is then able to start, adjust or vary (e.g., increase and decrease) the running operation of the motor based on detected thickness of the articles 31 received from the detector 21.

Figure 5:
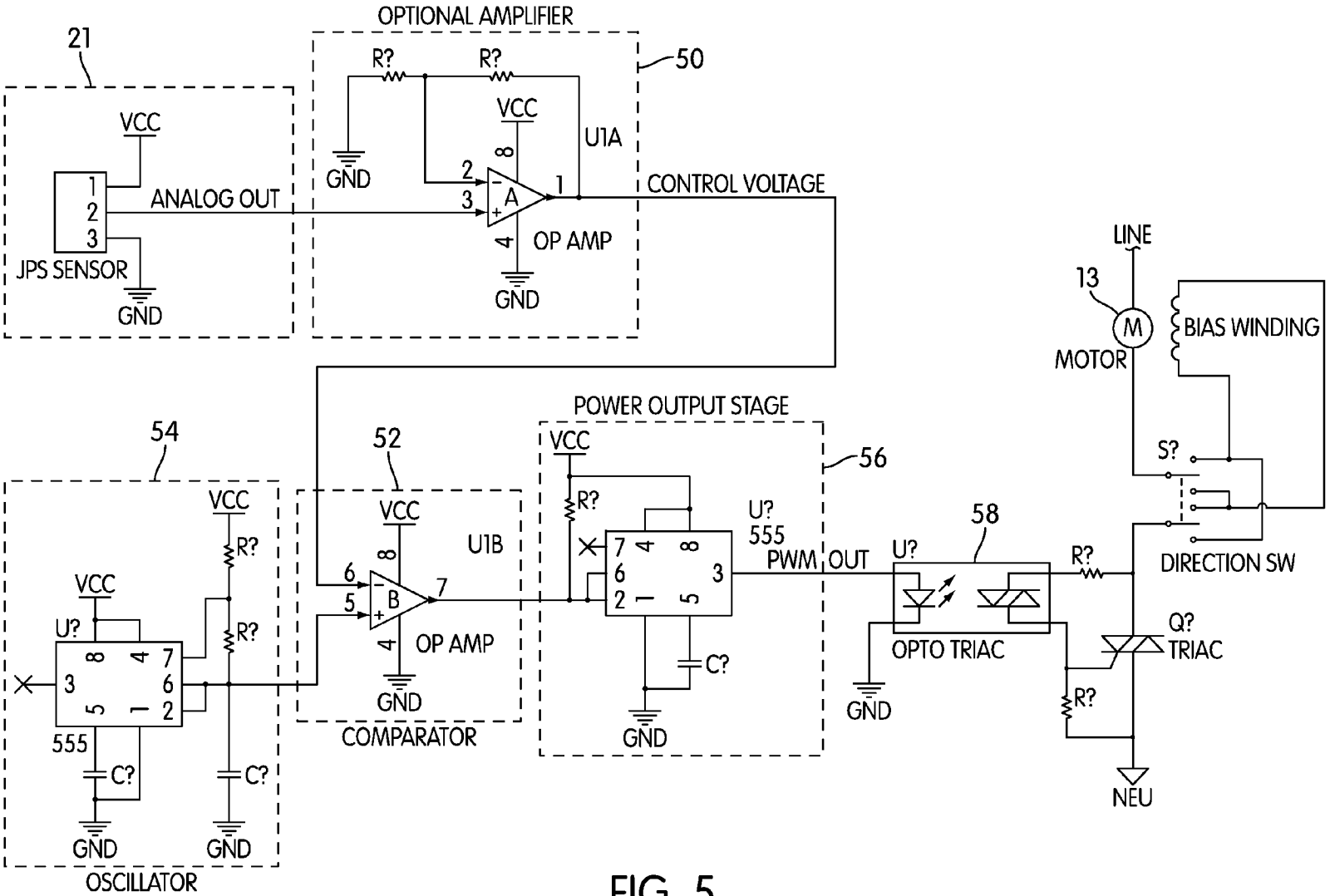
FIG. 5 is a schematic circuit illustration of an embodiment of the present invention, wherein the detector is interfaced to a timer circuit.
Figure 6:
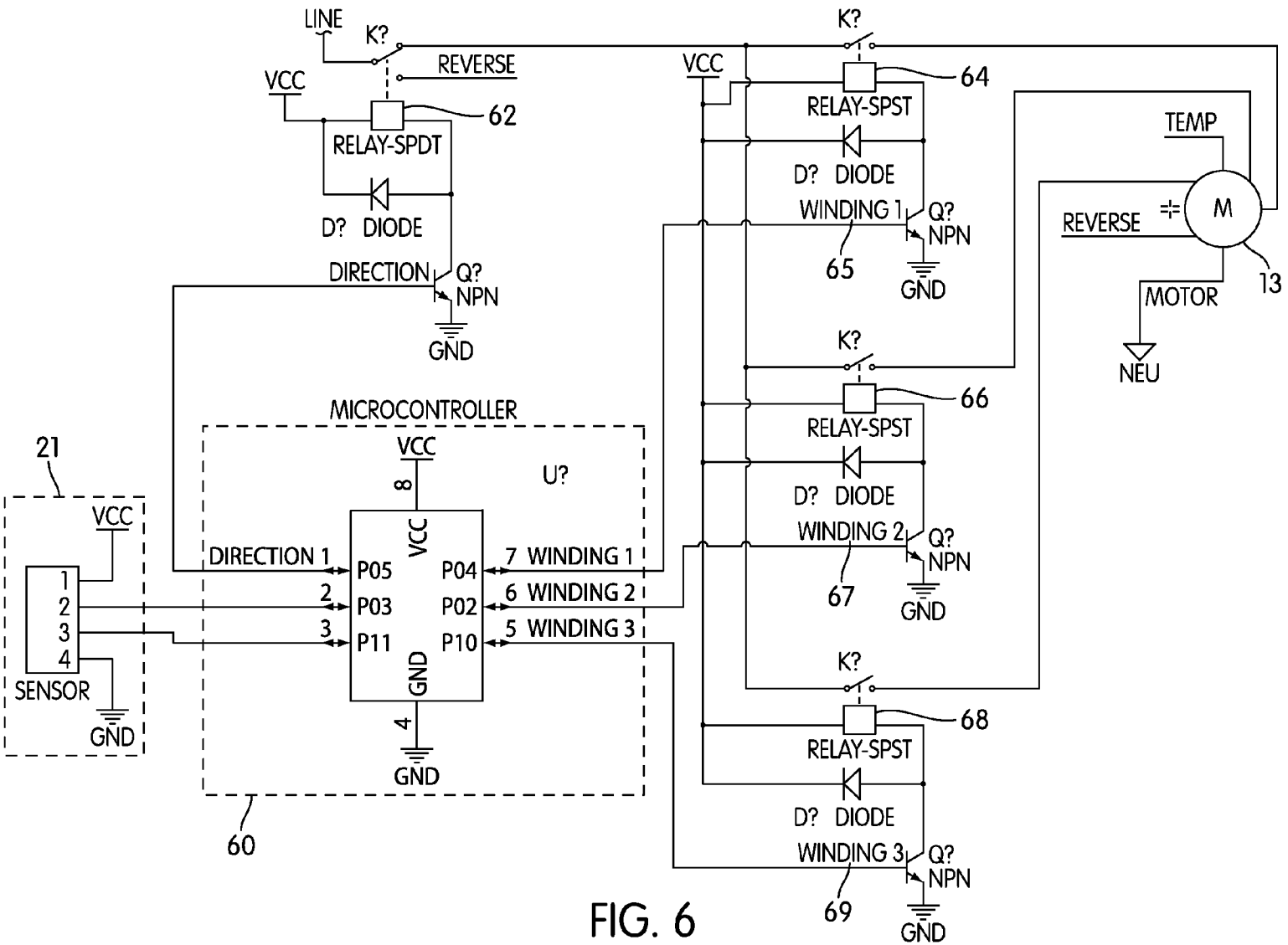
FIG. 6 is a schematic circuit illustration of an embodiment of the present invention, wherein the detector is interfaced to a microcontroller using multiple relays.
Figure 7:
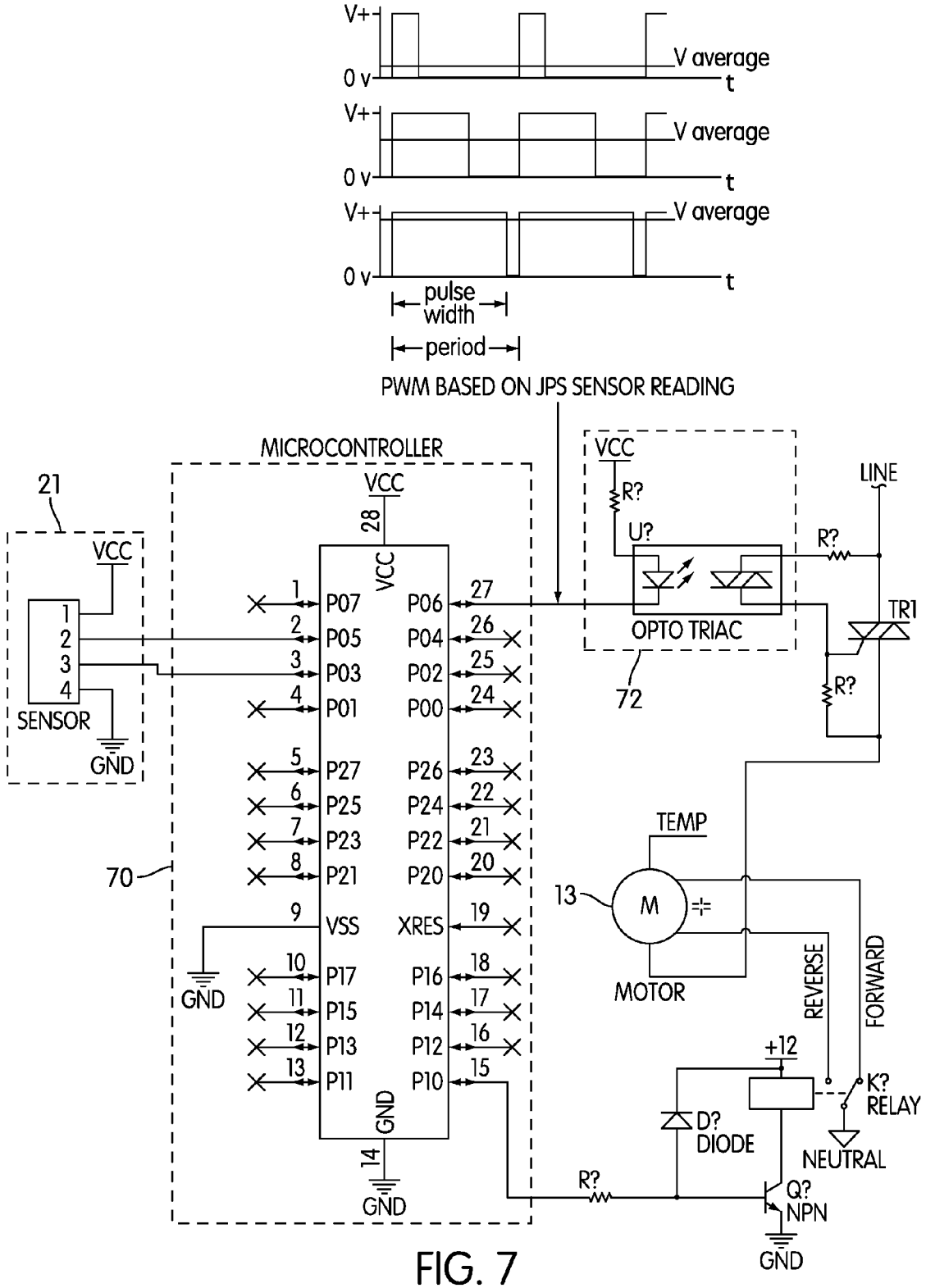
FIG. 7 is a schematic circuit illustration of an embodiment of the present invention, wherein the detector is interfaced to a microcontroller using pulse width modulation.

The controller 35 may be configured to adjust the torque of the motor 13 responsive to the detector 21 detecting the thickness of the at least one article 31 received by the throat 22. The controller may be configured to start a running operation of the motor at at least a predetermined minimum speed responsive to the detector 21 detecting the thickness of the at least one article 31 received by the throat 22 when the thickness is less than a predetermined maximum thickness threshold. The controller 35 may be configured to adjust speed of the motor 13 responsive to the detector 21 detecting the thickness of the at least one article 31 received by the throat 22. For example, the controller may be configured to incrementally increase or incrementally decrease the speed of the motor 13 responsive to the detector 21. The controller 35 may be configured to adjust torque of the motor 13 responsive to the detector 21 detecting the thickness of the at least one article 31 received by the throat 22. The controller 35 may be configured to adjust power usage of the motor 13 responsive to the detector 21 detecting the thickness of the at least one article 31 received by the throat 22. The controller 35 may be configured to prevent the motor 13 from driving the cutter elements and to provide an alarm indication to alert a user responsive to the detector 21 detecting that the thickness of the at least one article 31 is greater than a predetermined maximum thickness threshold. The alarm indication may include illuminating a visual indicator and/or sounding an audible alarm indicator. The controller 35 may include a microcontroller (as shown in FIGS. 6 and 7, for example) or a timer circuit (as shown in FIG. 5, for example). According to an aspect of the present invention, the controller 35 is configured to vary running operation of the motor continuously responsive to the detector detecting the thickness of the at least one article received by the throat. According to another aspect of the present invention, the controller 35 is configured to vary running operation of the motor based on predefined discrete ranges of thicknesses responsive to the detector detecting the thickness of the at least one article received by the throat. Additionally or alternatively, the controller 35 may be configured to stop the motor 13 when the detector 21 fails to detect at least one article being received by the throat 22 after a predetermined amount of time.

Figure 4:
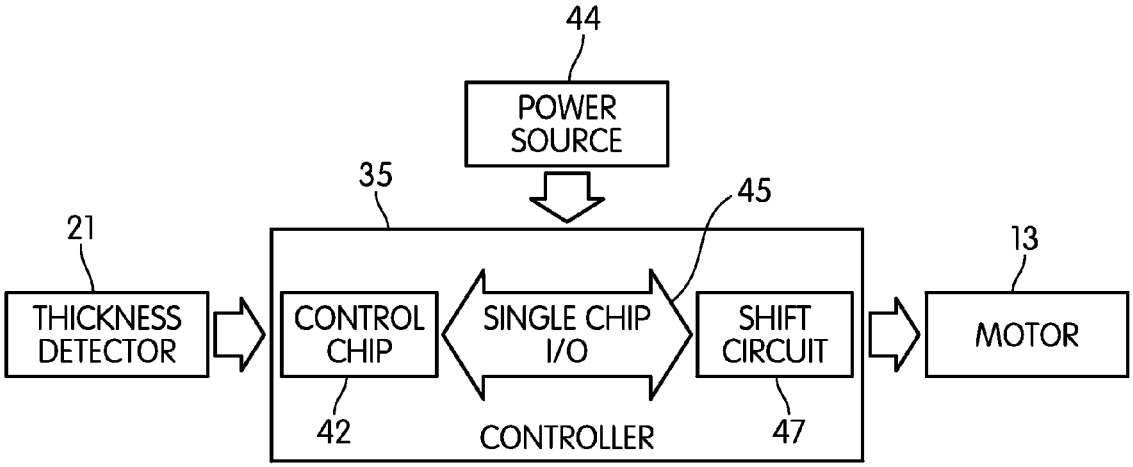
FIG. 4 is a schematic illustration of a more detailed implementation of the controller of FIG. 3 in accordance with an embodiment of the present invention.

FIG. 4 is a schematic illustration of a more detailed implementation of the controller 35 in accordance with an embodiment of the present invention. The controller or control circuit 35 includes a control chip 42, and a shift circuit 47 electrically connected via a single chip input/output 45. The controller or control circuit 35 is powered via a power source 44, and is capable of controlling the motor 13 with the use of the shift circuit 47. The control chip 42 is configured to receive the input signals from the detector 21. More specifically, control chip 42 is configured to receive the thickness of the article(s) 31 from the detector 21. The control chip 42 then sends information relating to the thickness of the article(s) 31 via the single chip input/output 45 to the shift circuit 47. The shift circuit 47 is configured to specify the operational setting for the motor 13. In other words, the shift circuit 47 is configured to generate a set of output signals that regulate the application of voltages to the motor 13. The shift circuit 47 determines the appropriate motor speed, motor torque or power setting to be used.

FIG. 5 illustrates a schematic circuit of an embodiment of the present invention, wherein the detector 21 is interfaced to a timer circuit. The embodiment, as shown in FIG. 5, illustrates a schematic circuit that does not require a microcontroller. As shown in FIG. 5, the circuit uses the thickness of the article(s) 31 detected by the detector 21. The output from the detector 21 may be an analog output. That is, as the thickness of the article(s) 31 detected by the detector 21 increases or decreases, a voltage or current that is produced by the detector may either increase or decrease its output accordingly. In one embodiment, the voltage or current produced by the detector output does not have to be directly proportional to the thickness of the articles 31 detected by the detector 21. The output from the detector 21 is then passed through an amplifier stage.

Alternatively, in embodiments, the timer circuit may be used to determine an amount of time for running the motor at speed for a predetermined amount of time. For example, as further described below with reference to FIG. 14, the timer may be used to run the motor at a speed for a predetermined amount of time while waiting for a detector to detect the presence of an article in the throat.

In the amplifier stage, an amplifier circuit 50 is configured to condition the output from the detector 21. This may be done to increase, offset, or filter the output from the detector 21. The amplifier stage is an optional stage, but may be used to bring the output range of the detector 21 to a desired level. The output of the amplifier stage (i.e., the conditioned signal) is then sent to a comparator stage.

In the comparator stage, a comparator circuit 52 is configured to compare the control voltage of the detector 21 to an output of an astable oscillator circuit 54. The positive input of the comparator stage is connected to the astable oscillator circuit 54 from a timer, such as a 555 timer. The frequency and pulse width are determined by the two resistors and the capacitor connected to pins 6 and 7 of the oscillator circuit 54. Based on the comparison, the comparator circuit 52 outputs a pulse width modulated (PWM) signal. The pulse width modulated signal produced by the comparator circuit 52 is directly proportional to the control voltage.

Figure 8:
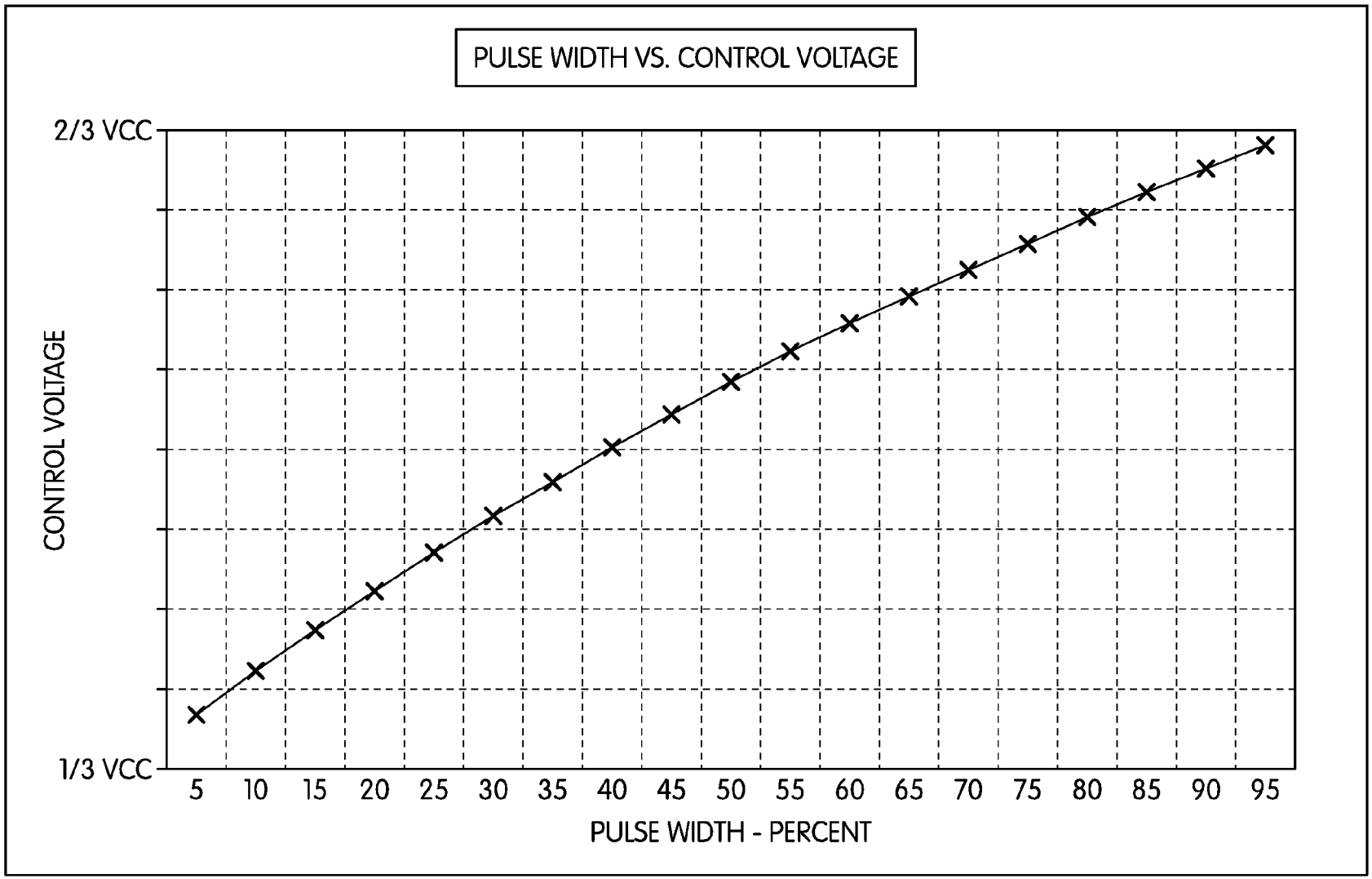
FIG. 8 is a graph illustrating the control voltage versus the pulse width modulated output signal.

FIG. 8 shows a graph illustrating pulse width modulation signal vs. control voltage. Graph illustrates the pulse width modulation signal as a percentage value represented on a horizontal x-axis. On a vertical y-axis, the graph illustrates control voltage.

The output duty cycle of the comparator circuit 52 increases as the output of the detector 21 increases. This relationship can be inverted if the pins of the comparator circuit 52 are switched. That is, the positive and negative signals for the comparator circuit 52 may be reversed to produce a decreasing pulse width for an increase in control voltage. The output of the comparator circuit 52 is then routed to a power output stage 56.

In the power output stage 56, a second timer, such as a 555 timer, is used to control the drive of an opto-TRIAC 58. The TRIAC 58 is turned on when the output of the second timer circuit is high. In other words, the pulse width modulation output from the power output stage 56 is fed into the TRIAC 58 which is used to drive the motor 13. The power output stage 56 is optional, but is used as an output buffer. Generally, an output buffer is used to drive an output of a device based on an output from another device. In other words, the output buffer is typically used when a device is not capable of driving the output directly. The power output stage 56, shown in FIG. 5, is used as an output buffer to drive the TRIAC 58, when the comparator stage 52 is unable to directly drive the TRIAC 58.

As the pulse width modulation (PWM) duty cycle increases, the TRIAC 58 will be turned on more and more. This will allow the motor 13 to run at full drive when the thickness of the article(s) 31 inserted into the throat is high. The resulting function is a change in motor speed and energy consumption relative to the output of the detector 21. As the thickness of the article(s) 31 inserted into the throat is high (e.g., higher the output from the detector 21), the speed of the motor 13 may be increased accordingly (e.g., such as shown and described in process 80 of FIG. 14). This allows the motor 13 to run as efficiently (and quietly) as possible.

In one embodiment, the circuit shown in FIG. 5 is configured to operate using a universal motor. When using the universal motor, the motor is configured to run at a low speed and a lower torque for thin documents. This is mainly because a lower duty cycle is not configured to deliver torque gains with the universal motors. As the thickness of the documents increases, duty cycle increases. As the duty cycle increases, the motor speed increases, which would in turn provide a nominal torque (i.e., a modulated torque).

In another embodiment, the circuit shown in FIG. 5 is modified to operate using a brushless DC motor (i.e., BLDC motor). In such configuration, the motor is configured to operate at a high speed and low torque for thin documents, and operate at a lower speed and higher torque for thicker documents.

Figure 9:
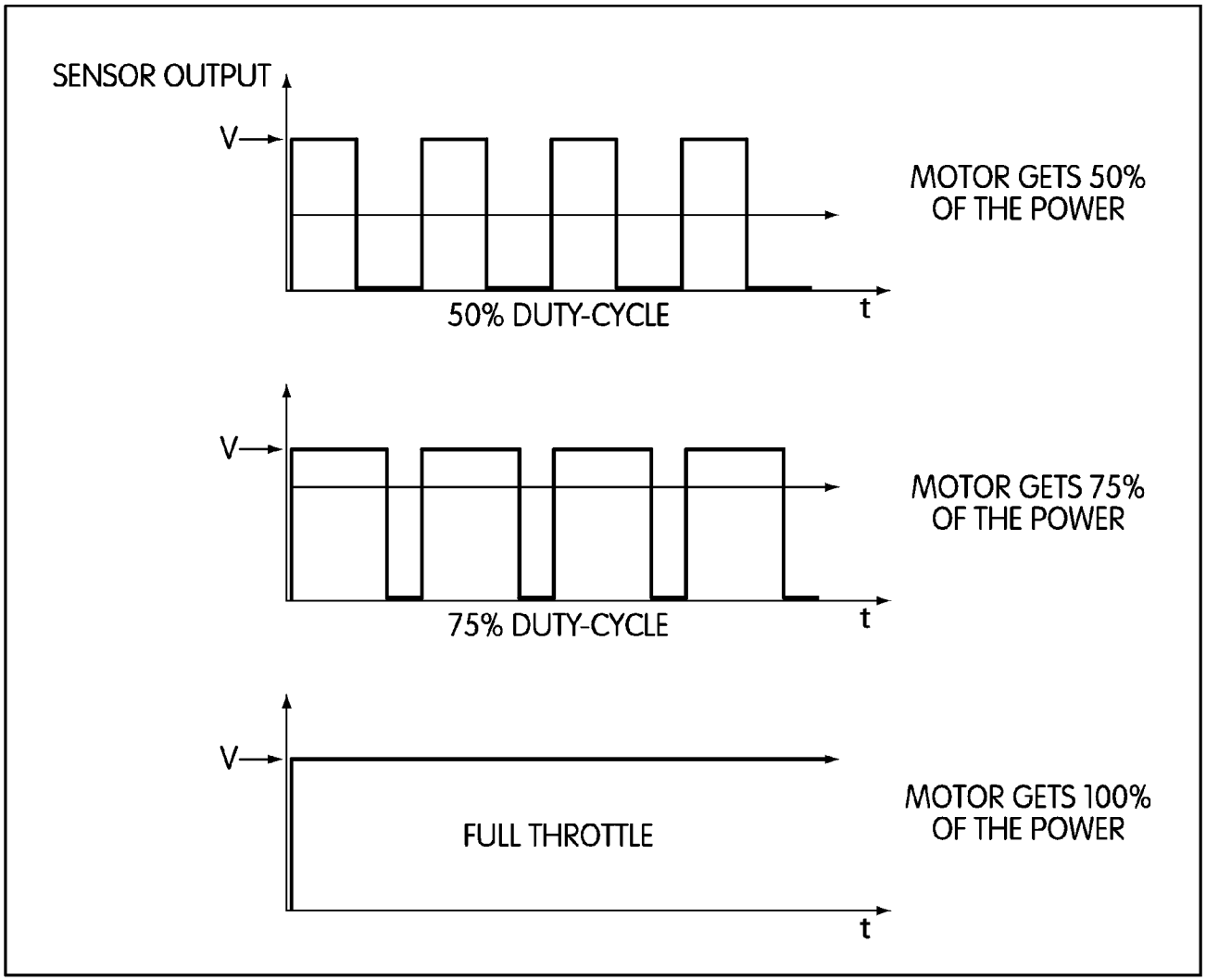
FIG. 9 shows various duty cycles of the pulse width modulated output signals.

FIG. 9 shows graphs of various duty cycles of pulse width modulation (PWM) output signals. For example, as shown in FIG. 9, when the pulse width modulation signal is at 50% duty cycle, the motor 13 is configured to receive 50% of the power, when the pulse width modulation signal is at 75% duty cycle, the motor 13 is configured to receive 75% of the power, and when the pulse width modulation signal is at its maximum, the motor 13 is configured to receive 100% of the power.

Of course, in order to further reduce noise in starting and run-on operations, the motor speed may be decreased accordingly as the article(s) 31 are finished being shredded. An example embodiment related to adjusting the drive signal (e.g., the PWM signal) to ramp up (quickly increase) or ramp down (quickly decrease) the motor speed is further discussed below with respect to FIGS. 11-14.

FIG. 6 illustrates is a schematic circuit illustration of an embodiment of the present invention, wherein the detector 21 is interfaced to a microcontroller 60 using multiple relays.

The output of the detector 21 is sent to the microcontroller 60. The detector 21 may produce an analog output, or a digital signal. The microcontroller 60 is configured to evaluate the output of the detector 21 and to power the different relays 64, 66 and 68 to the motor 13 accordingly. The different relays 64, 66 and 68 may be switched to control either: speed, energy consumption, and torque of the motor 13, for example. The switching of different relays 64, 66 and 68 may determined by software, such as, for example, a look-up table, curve, or function stored in the memory of the controller 35, that may be adjusted as required.

A relay 62 is configured to control the direction of rotation, while the other three relays 64-68 are used to switch power to different motor windings 65, 67 and 69 respectively. These windings 65, 67 and 69 can be used to provide, for example, extra torque, have different speed characteristics, etc. The utilization of the windings 65, 67 and 69 may be determined in a software, such as a look-up table, curve, or function stored in the memory of the controller 35, and may be based on the thickness of the article(s) 31 detected by the detector 21.

FIG. 7 illustrates is a schematic circuit illustration of an embodiment of the present invention, wherein the detector 21 is interfaced to a microcontroller 70 using pulse width modulation.

The output of the detector 21 is sent to the microcontroller 70. The detector 21 may produce an analog output, or a digital signal. Based on the output from the detector 21, the microcontroller 70 is configured to change the duty cycle of the motor drive by pulse width modulating an opto-TRIAC 72. This embodiment invokes a response similar to that described in the timer circuit with respect to FIG. 5.

The microcontroller 70 of this embodiment is used in the place of the amplifier circuit 50, the oscillator circuit 54, the comparator circuit 52, and power output stage 56 of the timer circuit described with respect to FIG. 5. FIG. 7 also shows various duty cycles of the pulse width modulation signal based on the thickness of the article(s) 31. This information is stored as calibration data in the memory of the controller 35, for example, in the form of a look-up table, curve, or function. Based off of the calibration data, the microcontroller 70 produces a pulse width modulation output relative to the appropriate thickness detected by the detector 21. The pulse width modulation output is sent to the TRIAC 72 and is used to drive the motor 13 at the appropriate duty cycle.

Figure 10:
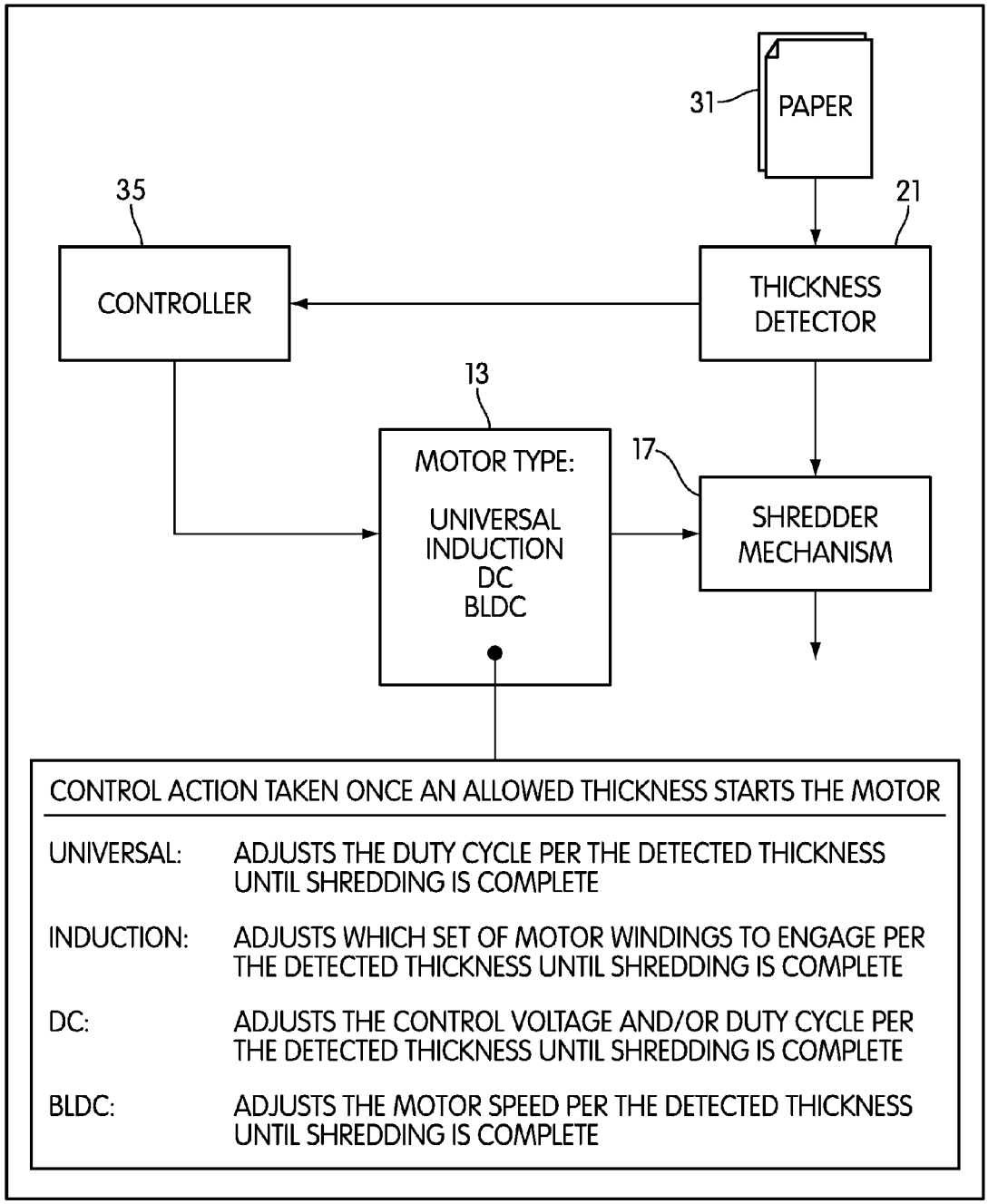
FIG. 10 shows a schematic illustration of interaction between the controller and other parts of the shredder, wherein different types of motors that may be used are shown.

As noted above, the present invention may be implemented in conjunction with an induction motor, a universal motor or a brushless DC motor or any other electric motor with capability for torque or speed control. FIG. 10 shows a schematic illustration of interaction between the controller and other parts of the shredder, wherein different types of motors that may be used are illustrated.

For example, when a universal motor is used in the shredder 10, the speed of the motor (e.g., the duty cycle of the drive signal) may be adjusted relative to the thickness of the at least one article being received by the throat. In other words, the duty cycle of the motor's drive signal is adjusted—to thus adjust the speed of the cutter elements of shredder mechanism—based on the detected thickness of the article until the shredding operation is complete. The universal motor allows for reduced audible noise, lower energy consumption, and more efficient use of the motor.

When an induction motor is used, multiple motor windings may be switched according to the thickness of the at least one article being received by the throat (e.g., a two speed induction motor). In other words, the induction motor determines and adjusts a set of motor windings that are to be engaged based on the detected thickness of the article until the shredding is complete. The induction motor may also be pulsed like the universal motor. In one embodiment, different motor capacitors may be switched into the system to change the behavior of the motor. The induction motor allows for increased throughput, reduced audible noise, and increased gain efficiency of the motor.

When a Brushless DC (BLDC) motor is used, the speed of the motor is may be altered by changing the drive signal relative to the thickness of the at least one article being received by the throat (e.g., a pulse width modulation may be used). In other words, the BLDC motor adjusts the duty cycle and/or the control voltage based on the detected thickness of the article until the shredding is complete. The BLDC motor takes advantage of the speed-torque inverse relationship. The BLDC motor allows for energy savings, reduced audible noise, increased throughput, and the ability to "overdrive" the system.

When a DC motor is used, the duty cycle of the drive signal may be adjusted relative to the thickness of the at least one article being received by the throat. In other words, the DC motor adjusts the motor speed via adjustment of the duty signal (such as noted above with a universal motor) based on the detected thickness of the article until the shredding is complete. In one embodiment, when the DC motor is used, the source voltage may be altered.

In order to adjust the speed (e.g., increase and/or decrease rotating speed) of any of the motors as described above, any number of methods may be used. As previously noted, in embodiments, it may be advantageous to control the ramping up/down of the motor speed (e.g., via duty cycle adjustment) to thereby reduce audible noise made by the shredder 10 and its shredder mechanism 17 in starting and run-on operations. For example, in an embodiment that utilizes a universal type motor, when the detector 21 determines that an article should be shredded (i.e., that the motor 13 should be turned on and thus the shredder mechanism 17 rotated), the start of the motor 13 may cause loud noises. Additionally, after the article (s) have been fed through the throat 22 and shredded, and there is no load or article(s) being shredded, the run-on operation of the universal type motor may also provide a loud, unwanted noise until paper is inserted into the throat, or the operation of the motor is completely stopped.

Figure 11:
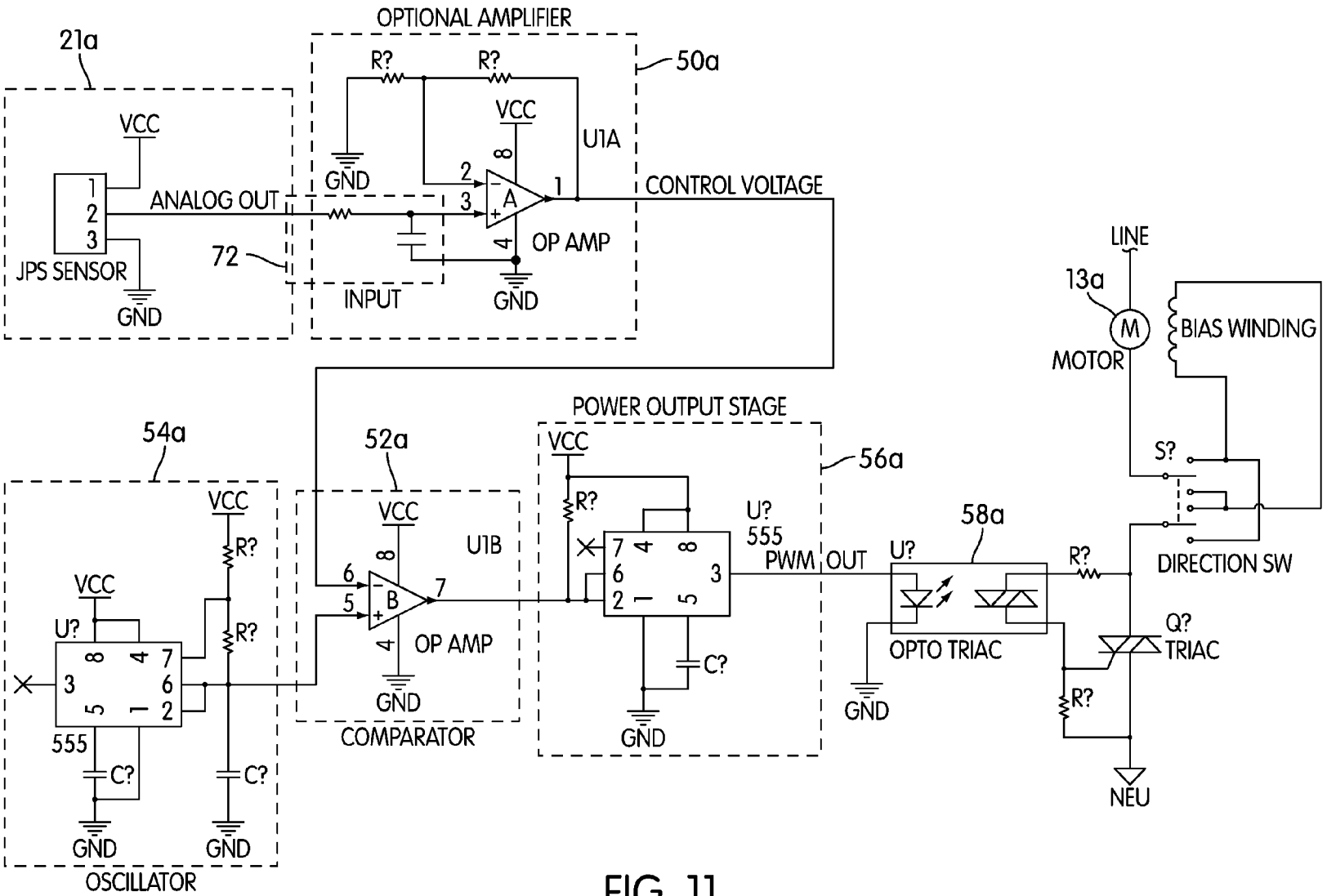
FIG. 11 is a schematic circuit illustration of another embodiment of the present invention, wherein the detector is interfaced to a timer circuit, and wherein an RC network input and a low-pass filter are provided to perform ramping up/down functions of the motor speed.

FIG. 11 illustrates a schematic circuit of an embodiment of the present invention, wherein the detector 21*a* is interfaced to a timer circuit. Like FIG. 5, this embodiment illustrates a schematic circuit that does not require a microcontroller. As shown in FIG. 11, the circuit uses the thickness of the article (s) 31 detected by the detector 21*a*. The circuit of FIG. 11 may include like features as described above with respect to the embodiment of FIG. 5. More specifically, similar reference numerals which represent similar features are used in FIG. 5 as well as in FIG. 11. For example, an amplifier circuit 50*a* is configured to condition the output from the detector 21*a*. The output of the amplifier stage (i.e., the conditioned signal) is then sent to a comparator stage. A comparator circuit 52*a* is configured to compare the control voltage of the detector 21*a* to an output of an astable oscillator circuit 54*a*. The positive input of the comparator stage is connected to the astable oscillator circuit 54*a* from a timer, such as a 555 timer. Based on the comparison, the comparator circuit 52*a* outputs a pulse width modulated (PWM) signal. The pulse width modulated signal produced by the comparator circuit 52*a* is directly proportional to the control voltage.

The output of the comparator circuit 52*a* is then routed to a power output stage 56*a*. Also, in the power output stage 56*a*, a second timer, such as a 555 timer, is used to control the drive of an opto-TRIAC 58*a*. Again, as the pulse width modulation (PWM) duty cycle increases, the TRIAC 58*a* may be turned on more and more. This will allow the motor 13*a* to run at full drive when the thickness of the article(s) 31*a* inserted into the throat is high. The resulting function is a change in motor speed and energy consumption relative to the output of the detector 21*a*. As the thickness of the article(s) 31*a* inserted into the throat is high (e.g., higher the output from the detector 21), the speed and power of the motor 13*a* is increased accordingly.

In this embodiment, by programming the device such that the drive signal (e.g., the PWM signal) may be adjusted, the speed of the motor 13*a* is ramped up/down to accommodate and reduce or prevent abrupt starting and stopping of the motor. Software may be used to provide such variable speed motor control. However, other than using software to perform this operation, components may also be provided on an analog input as well. As shown in FIG. 11, for example, an RC network is provided as an input low pass filter (LPF) between the detector 21*a* and the amplifier circuit 50. Thus, the analog output from the detector 21*a* (i.e., sensor) is then passed to the input LPF 72. The capacitor 74 of the RC network/input LPF 72 decreases the amount of time for ramping the power of the motor 13*a* up or down. That is, the LPF 72 works to increase or decrease the motor speed by slightly adjusting the percentage of full voltage or power over time that is sent as output to the amplifier circuit 50 (and thus TRIAC 58). As such, the controller 35 may be used to control the speed of the motor 13*a*.

For example, in embodiments, the article(s) 21 may be detected by auto-start sensors and then detector 21. Upon detection by the auto-start sensors, the motor 13*a* may be provided with some power to start rotation and then ramped up or increased gradually to full power upon detection of the thickness of the article(s) 31 by the detector 21. Additionally and/or alternatively, as the article(s) 31 are shredded, the thickness detector 21 (and/or some other sensors) may determine or read a thickness of "0" (zero) in the throat 22. Such a determination may mean that a trailing edge of the article(s) 31 have passed through at least the throat 22. As such, the power to the motor 13*a* may be ramped down or decreased gradually so that the motor is not running at full speed after the article(s) 31 have cleared the cutters of the shredder mechanism 17.

Figure 12:
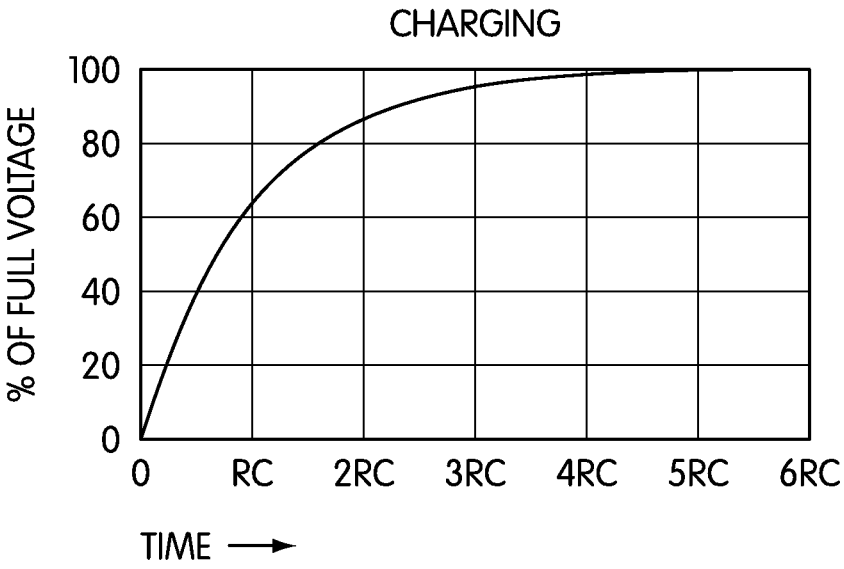
FIGS. 12 and 13 illustrate examples of graphs showing the percentage of power versus the time for adjusting the speed up and down, respectively, of a motor in the shredder.
Figure 13:
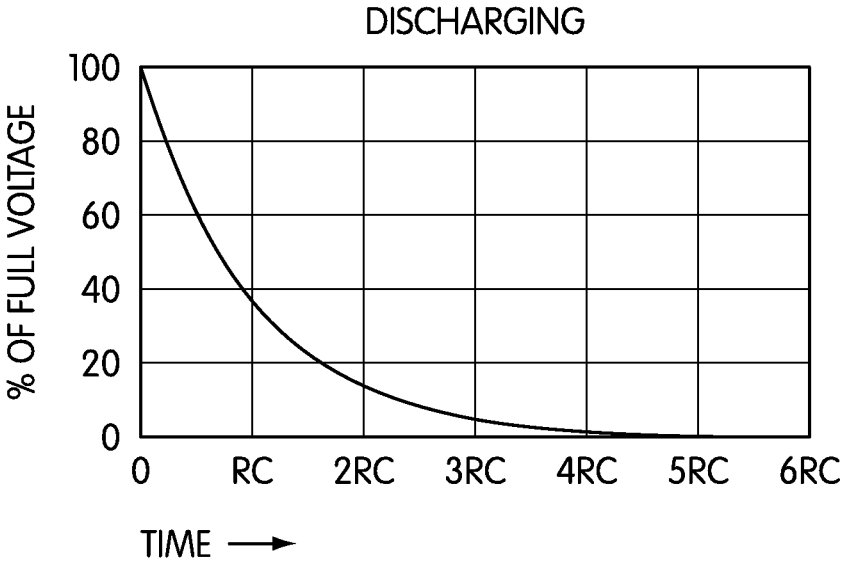

FIGS. 12 and 13 illustrate examples of increasing the speed of the motor and decreasing the speed of the motor, respectively, in accordance with the present invention. As shown, the percentage of power sent to the motor 13*a* is designed to be quickly increased/decreased in a short period of time at first (e.g., between 0 and about 2RC, with respect to the time as depicted), but does not change quickly over time once the signal begins approaching the target input (e.g., full power, reduced power, or no power).

In some embodiments, the detector 21 and circuit as shown in FIG. 11 may be used in combination with any number of other sensors to send signals to the controller 35, for example, to adjust the speed of the motor 13*a* such that it increases or decreases. As noted in the example above, it may be used in accordance with auto-start sensors such that the motor is started and gradually increased. Additionally, the motor 13*a* may be programmed such that after it is powered, it stays at a minimal, pre-programmed speed until one or more auto-start sensors detect the presence of an article 31 (e.g., in the throat 22). Upon detection of an article 31, the power to the motor 13*a* would be at least temporarily increased (thereby increasing the speed of rotation of the cutter elements) so that the article is shredded. If another article 31 is not detected by the detector, the speed of the motor 13*a* is decreased and ramped back down again. Also, in some cases, if another article is not detected in a throat, the operation of the motor may be stopped.

The invention may also adjust the power to the motor 13*a* based on the length(s) of the article(s) that are shredded. For example, the output power to the motor 13*a* may be ramped up about or after a time of shredding at least one article. Also, it may be used with jam detection sensors to adjust the speed should a paper jam be detected. For example, upon detection of a jam within the shredder mechanism 17, the speed of the motor 13*a* may be temporarily increased to possibly remove excess particles from the cutter elements.

Figure 14:
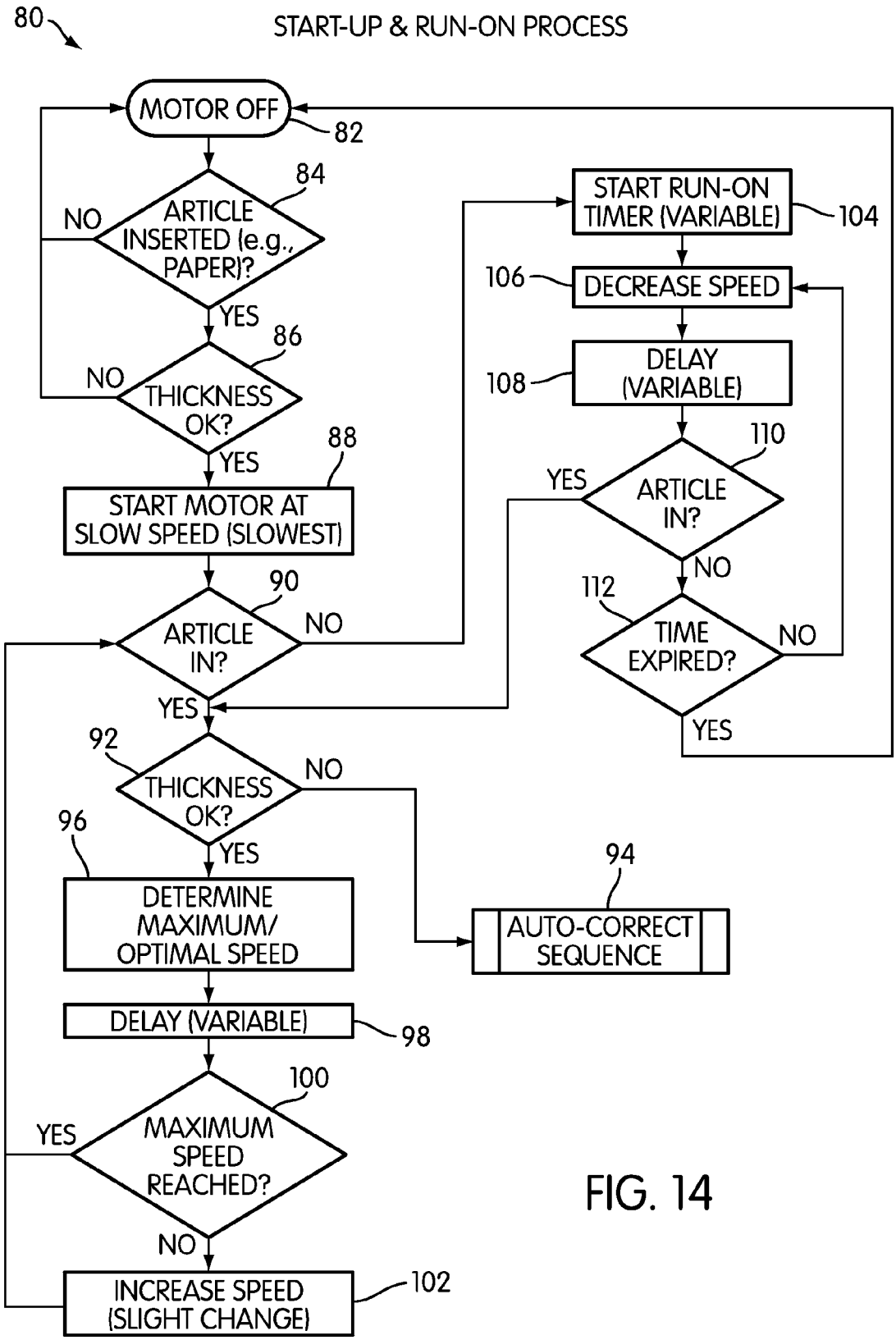
FIG. 14 is a flow diagram illustrating a process for starting and running the motor of the shredder of FIG. 1 using the circuit of FIG. 11 in accordance with an embodiment of the present invention.

FIG. 14 illustrates a flow diagram illustrating a process 80 for starting and running the motor 13*a* under variable speeds using the circuit of FIG. 11, for example, with a jam proof sensor system, in accordance with an embodiment of the present invention. U.S. application Ser. No. 11/867,260, filed Oct. 4, 2007 and U.S. application Ser. No. 12/409,896, filed Mar. 24, 2009, both of which are assigned to the same assignee, provide examples of such sensor system that may be used. The process 80 is described in the following paragraphs with respect to starting, running, increasing the speed the motor (i.e., ramping it up), and decreasing the speed of the motor (i.e., ramping it down). However, it is to be understood that similar concepts with respect to adjusting the torque of the motor and/or adjusting the power usage of the motor responsive to the detector detecting (or not detecting) the thickness of at least one article being received in the throat 22 may be implemented and are within the scope of the method and system as disclosed in the present invention.

The method or process 80 may begin at 82 when the motor is off, for example, to start up the motor. If article insertion is not detected (e.g., by the detector 21 or by another sensor) in the throat 22 at 84, i.e., "NO," the motor remains off at 82. However, if the throat insertion of at least one article is detected at 84, i.e., "YES," it is then determined at 86 if the thickness of the at least one article is sufficient and is less than a predetermined maximum thickness threshold. If the detector 21 determines that the article inserted in the throat 22 is too thick (i.e., greater than the predetermined maximum thickness threshold) or exceeding the capacity of the shredder, for example, i.e., "NO," the motor is turned off at 82. In some instances, the controller is configured to prevent the motor from driving the cutter elements. In some instances, an alarm indication may be provided to alert a user as a response to the detector detecting that the thickness of the at least one article is greater than a predetermined maximum thickness threshold.

If the detector 21 determines that the thickness is sufficient and is less than a predetermined maximum thickness threshold at 86, i.e., "YES," a running operation of the motor 13*a* is started at 88 at least a predetermined minimum speed. In some embodiments, the predetermined minimum speed may be a slower or a slowest speed for the motor. This, in turn, rotates the cutter elements at a corresponding slow or minimum speed. Of course, as generally described above, it is to be understood that the detector 21 may work in cooperation with the controller 35 and/or elements to make such determinations.

After the motor is started and/or running, article(s) or paper may be shredded via the shredder mechanism. As will become further evident, the controller may also be configured to adjust speed from the predetermined minimum speed (i.e., after starting) responsive to the detector. In some cases, a "run-on" operation or process may be utilized in some embodiments of the present invention. A "run-on" process is defined as a running operation of the motor for a predetermined period of time to rotate the cutter elements of the shredder mechanism after one or more articles has been shredded. For example, after a shredding operation has started and completed, a run-on process may continue the running operation of the motor based on whether or not at least one article is or is not detected as being present in the throat during a period of time. As described below at 104-112, the speed (or torque or power usage) of the motor may be adjusted responsive to the detector detecting the thickness of the at least one article.

As such, after the motor has started in the start-up process as indicated by 82-88 of FIG. 14, it may determined or verified at 90 if an article is within the throat 22 for shredding. If the article is in the throat 22 at 90, i.e., "YES," it may be determined (or verified if the motor has already been started at 88 or started in the run-on process discussed below at 104) if the thickness is below a predetermined maximum thickness threshold at 92. If the thickness is not below the predetermined maximum threshold, i.e., "NO," an auto-correct sequence as shown at 94 is implemented (e.g., stopping the motor). Such sequences are generally known in the art and not discussed in detail herein.

If the thickness is less than a predetermined maximum thickness threshold, i.e., "YES"—the thickness is OK, a maximum and/or optimal speed for the running motor may be determined at 96 in the process 80. That is, the maximum and/or optimal speed for rotating the cutter elements of the shredder mechanism 17 to cut the at least one article 31 and its detected thickness may be determined at 96. In some cases, the cutting speed, torque, or power output for shredding the article may be adjusted based on a determined thickness of the article (e.g., the thickness may be determined at 92). Also, in some instances, the rotational speed of the motor, torque, or power output may be determined based on the type or model of machine.

In some cases, such as shown at 98, one or more delays may be implemented. The delays may be used to time the adjustment of the speed of the motor 13*a* between speeds. In some implementations, the delays 98 may be variable. For example, the delays may be varied based on the type of shredder and the type of motor being used in such a shredder. In an embodiment, the delays may be predetermined and/or based on a look-up table, for example. In the described embodiments, the delays may be varied based upon the motor characteristics and controlling the resulting noise associated with running the motor. The variable delay may be set based upon the amount of variation or change in motor speed from the motor's current speed. For example, a shorter delay may be implemented as the speed of the motor 13*a* is first adjusted, and, as the speed of the motor approaches the maximum or optimal speed determined at 96, the speed of the motor 13*a* may adjusted less frequently.

Providing variable delay(s) may be useful for a number of reasons. For example, such delays provide smoother transitions when changing the speed of rotation of the motor(s). Also, variable delay(s) in a shredder allow time for article(s) to be shredded in cutter elements and/or clear the cutter elements of the shredder mechanism, for example, when a motor speed is slowly ramping up to a desired speed, and/or when a motor speed is winding down. Generally, the delays are dynamically variable based upon the machine and conditions for performing shredding functions, and thus should not be limited.

Referring back to FIG. 14, it may be determined at 100 if the maximum or optimal speed of the motor is reached. If "YES," i.e., the optimal speed is reached, the cutter elements continue to rotate at the provided motor speed (e.g., a predetermined speed, such as the speed at which the motor was started at 88), and the article is shredded via shredder mechanism 17. The process then continues or is repeated at 90 by determining if an article is (still) within the throat 22. If the article is still within the throat 22, and the maximum or optimal speed is reached, the shredding process at that speed continues until the entire article is shredded and no longer detected at 90. Alternatively, if, as the shredding process continues, the thickness is not "OK" at 92, an auto-correct sequence may be implemented at 94. This may happen, for example, when a user adds one or more additional articles to the throat 22 to be shredded that either alone or in combination with the at least one article comprise a thickness that is larger than a predetermined maximum thickness threshold. Therefore, in some cases, the controller may be configured to vary running operation of the motor with respect to the predetermined minimum speed such that it is continuously responsive to the detector detecting the thickness of the at least one article being received by the throat.

If, while the motor and thus the shredder mechanism is running, the maximum or optimal speed is not reached at 100, i.e., "NO," a slight incremental change or increase in speed of the motor may be implemented at 102. The shredding process of the at least one article may then be repeated (e.g., thickness being continuously verified) and the speed incrementally increased, as needed, to the maximum or optimal determined speed based on the thickness, until the at least one article is no longer detected in the throat 22.

In some embodiments, the controller may be configured to adjust the speed of the motor response to the detector failing to detect the presence of at least one article in the throat 22. For example, when at least one article has been shredded and is no longer detected at 90, i.e., "NO," a run-on operation or process may be implemented. In this case, the controller may be configured to varying running operation of the motor from a predetermined minimum speed responsive to the detector detecting (or not detecting) the thickness of at least one article. In some cases, the controller may be configured to incrementally increase and/or incrementally decrease speed of the motor from its active rotating speed.

In the run-on process as shown in 90 and 104-112 of FIG. 14, after the motor is running after a previous shredding operation, for example, a run-on timer may be started at 104 for a predetermined amount of time. The predetermined amount of time is may be set for detecting if another article is received by the throat after the at least one article is shredded. The run-on timer at 104 may be set to allow the controller to communicate with and power the motor for a predetermined amount of time. Like the delay at 98, the run-on timer may be variable. For example, the amount of time that the motor is run at the provided speed (e.g., at the speed last reached at 100) may be adjusted. Thereafter, the speed may be decreased by an increment at 106. In some cases, the increments for decreasing the speed may be predetermined. The advantages of reducing the motor speed when an article is not present are detailed above. Again, another delay may be implemented at 108. The delay 108 may also be variable. For example, a shorter delay may be implemented as the speed of the motor 13*a* is first adjusted, and, as the speed of the motor approaches the minimum speed for rotation, the speed of the motor 13*a* may adjusted less frequently.

The run-on process allows for varying of the running operation of the motor by adjusting speed of the motor responsive to the timer. In some cases, the controller is configured to adjust torque of the motor responsive to the timer. In some cases, the controller is configured to adjust power usage of the motor responsive to the timer.

As shown in FIG. 14, the controller can allow running operation of the motor at a decreased speed implemented at 106 after the timer is started at 104. At 110 it is determined if an article 31 is inserted into the throat 22 or is detected by detector 21. If "YES," i.e., if at least one article is detected as being present by the detector 21 or another sensing device as being received by the throat, the process for running the motor, i.e., determining if the thickness is below a predetermined maximum thickness threshold at 92, determining maximum or optimal speed at 96, etc., is then implemented to shred the at least one article using the shredder mechanism 17. As noted above, the controller may incrementally increase the speed of the motor until the article is shredded.

However, if an article is not detected at 110 by detector 21 or another sensing device as being received by the throat 22, it is determined at 112 if the predetermined amount of time for running operation of the motor as determined by run-on timer (started at 104) has expired. If the predetermined time for running the motor at a decreased speed has run out or expired, and thus the detector fails to detect the presence of another article being received by the throat, i.e., "YES," the operation of the motor 13*a* may be turned off or stopped by the controller at 82. If the time for running the motor in the run-on process has not run out, i.e., "NO," the speed may be further incrementally decreased at 106. Alternatively, the motor may continue running at its set speed. In some cases, the running operation of the motor may be varied until it reaches a start speed such as noted at 88.

As such, FIG. 14 illustrates just some examples of why variable control of the motor speed, including starting, increasing, and decreasing operational speeds based on the detector detecting the thickness of one or more articles, is an advantageous embodiment. Specifically, unwanted noise from the running motor (with no articles or paper in the shredder) is decreased or eliminated by reducing and/or stopping the speed of the motor.

Furthermore, it should be noted that this embodiment of the invention may also be used in accordance with one or more audio and/or vibration sensors. Generally, for example, audio sensors may be used to control or minimize the amount of noise being produced by a machine. In embodiments, the motor 13*a* may be controlled (i.e., its speed increased or decreased) based on output noise (or vibration) being detected by one or more audio sensors of the shredder. For example, if the detected amount of noise is too loud, the speed of the motor may be gradually reduced. U.S. Provisional Patent Application 61/226,902, filed Jul. 20, 2009, which is hereby incorporated by reference in its entirety, describes one example of an audio/vibration sensor that may be used.

Besides reducing and/or eliminate the audible noise produced by the machine, adjusting the drive signal by ramping the motor speeds up or down also reduces flash event possibilities when rocking the switch back and forth (e.g., when software is programmed and used to control the speed on brushed motors).

The foregoing illustrated embodiments have been provided to illustrate the structural and functional principles of the present invention and are not intended to be limiting. To the contrary, the present invention is intended to encompass all modifications, alterations and substitutions within the spirit and scope of the appended claims.

What is claimed is:

1. A shredder comprising:

a housing having a throat for receiving at least one article to be shredded;

a shredder mechanism received in the housing and including an electrically powered motor and cutter elements, the shredder mechanism enabling the at least one article to be shredded to be fed into the cutter elements and the motor being operable to drive the cutter elements so that the cutter elements shred the at least one article fed therein;

an input device for transmitting an input parameter, the input parameter indicating a physical characteristic of the at least one article being received by the throat; and a controller coupled to the motor and the input device, the controller being configured to receive the input parameter and configured to start a running operation of the motor at at least a predetermined minimum speed after the input parameter of at least one article is received by the controller;

the controller being configured to determine a maximum speed for the motor based on the input parameter from the input device;

the controller also being configured to incrementally increase the running operation of the motor from the predetermined minimum speed to the determined maximum speed for shredding the at least one article using the cutter elements, and wherein the controller is configured to stop operation of the motor from driving the cutter elements upon the detector failing to detect another article being received by the throat after a predetermined amount of time.

2. The shredder according to claim 1, wherein the input device is a detector configured to detect a thickness of the at least one article being received by the throat, and the input parameter indicates the detected thickness.

3. The shredder according to claim 2, wherein the controller is further configured to start a timer for the predetermined amount of time for detecting the another article being received by the throat after the at least one article is shredded.

4. The shredder according to claim 3, wherein the controller is further configured to adjust speed of the motor responsive to the timer.

5. The shredder according to claim 4, wherein the controller is configured to incrementally decrease the running operation of the motor before stopping operation of the motor.

6. The shredder according to claim 3, wherein the controller is further configured to adjust torque of the motor responsive to the timer.

7. The shredder according to claim 3, wherein the controller is further configured to adjust power usage of the motor responsive to the timer.

8. The shredder according to claim 2, wherein the controller is configured to implement a time delay for each incremental increase in speed so that the running operation of the motor is held for a predetermined amount of time at each increment.

9. The shredder according to claim 2, wherein the controller comprises a microcontroller.

10. The shredder according to claim 2, wherein the controller comprises a timer circuit.

11. The shredder according to claim 2, wherein the detector comprises a contact member that extends into the throat and is actuated in response to the article being inserted into the throat.

12. The shredder according to claim 2, wherein the controller is configured to vary running operation of the motor continuously responsive to the detector detecting the thickness of the at least one article being received by the throat.

13. The shredder according to claim 2, wherein the controller is configured to vary running operation of the motor based on predefined discrete ranges of thicknesses responsive to the detector detecting the thickness of the at least one article being received by the throat.

14. The shredder according to claim 2, wherein the controller is configured to adjust speed of the motor responsive to the detector failing to detect the presence of an article in the throat.

15. A method for operating a shredder comprising a housing having a throat for receiving at least one article to be shredded, an input device for transmitting an input parameter indicating a physical characteristic of the at least one article being received by the throat, a controller coupled to the motor and the detector, and a shredder mechanism received in the housing and including an electrically powered motor and cutter elements, the shredder mechanism enabling the at least one article to be shredded to be fed into the cutter elements and the motor being operable drive the cutter elements in a shredding direction so that the cutter elements shred the articles fed therein; the method comprising:

transmitting the input parameter indicating the physical characteristic of the at least one article being received by the throat from the input device to the controller;

receiving the input parameter via the controller;

starting a running operation of the motor using the controller at at least a predetermined minimum speed after the at least one article is detected by the detector;

determining a maximum speed for operating the motor based on the transmitted input parameter from the input device;

increasing the miming operation of the motor in increments to the determined maximum speed, and stopping operation of the motor from driving the cutter elements using the controller upon the detector failing to detect another article being received by the throat after a predetermined amount of time.

16. The method according to claim 15, wherein the input device is a detector detecting a thickness of the at least one article being received by the throat, and the input parameter indicates the detected thickness.

17. The method according to claim 16, further comprising starting a timer for the predetermined amount of time for detecting the another article being received by the throat after the at least one article is shredded.

18. The method according to claim 17, further comprising varying running operation of the motor by adjusting speed of the motor responsive to the timer.

19. The method according to claim 17, wherein varying running operation of the motor comprises adjusting torque of the motor responsive to the timer.

20. The method according to claim 17, wherein varying running operation of the motor comprises adjusting power usage of the motor responsive to the timer.

21. The method according to claim 16, further comprising decrease the running operation of the motor in increments before stopping operation of the motor.

22. The method according to claim 16, further comprising implementing a time delay using the controller for each incremental increase in speed so that the running operation of the motor is held for a predetermined amount of time at each increment.

23. The method according to claim 16, wherein the controller comprises a microcontroller.

24. The method according to claim 16, wherein the controller comprises a timer circuit.

25. The method according to claim 16, wherein the detector comprises a contact member that extends into the throat and is actuated in response to the article being inserted into the throat.

26. The method according to claim 16, further comprising varying running operation of the motor using the controller such that the running operation is continuously responsive to the detector detecting the thickness of the at least one article being received by the throat.

27. The method according to claim 16, further comprising varying running operation of the motor using the controller based on predefined discrete ranges of thicknesses responsive to the detector detecting the thickness of the at least one article being received by the throat.

28. The method according to claim 16, further comprising varying running operation of the motor by adjusting speed of the motor responsive to the detector failing to detect the presence of an article in the throat.

* * * * *